US007219513B1

(12) United States Patent
Mostafa

(10) Patent No.: US 7,219,513 B1
(45) Date of Patent: May 22, 2007

(54) ETHANE PLUS AND HHH PROCESS FOR NGL RECOVERY

(76) Inventor: Hussein Mohamed Ismail Mostafa, 22 Dr. Mohamed Awad Street, Off Makram Ebid Street, 2nd Floor, Apartment #6, Six District, Nasr City, Cairo (EG)

( * ) Notice: Subject to any disclaimer, the term of this patent is extended or adjusted under 35 U.S.C. 154(b) by 316 days.

(21) Appl. No.: 10/977,891

(22) Filed: Nov. 1, 2004

(51) Int. Cl.
*F25J 3/00* (2006.01)

(52) U.S. Cl. ..... 62/620; 62/621

(58) Field of Classification Search ..... 62/620, 62/621

See application file for complete search history.

(56) References Cited

U.S. PATENT DOCUMENTS 5,992,175 A * 11/1999 Yao et al. ..... 62/621
6,237,365 B1 * 5/2001 Trebble ..... 62/621
6,453,698 B2 * 9/2002 Jain et al. ..... 62/621
6,578,379 B2 * 6/2003 Paradowski ..... 62/622
6,581,410 B1 6/2003 Johnson et al.
7,107,788 B2 * 9/2006 Patel et al. ..... 62/625
2002/0166336 A1 11/2002 Wilkinson et al.
2004/0148964 A1 8/2004 Patel et al.
2005/0204774 A1 * 9/2005 Foglietta et al. ..... 62/620
2005/0229634 A1 * 10/2005 Huebel et al. ..... 62/632
2005/0255012 A1 * 11/2005 Mak ..... 422/187

* cited by examiner

*Primary Examiner*—William C. Doerrler
(74) *Attorney, Agent, or Firm*—David T. Bracken

(57) ABSTRACT

The present invention relates to methods for separating and recovering ethane, propane and heavier components from a feed gas, e.g. raw natural gas or a refinery or petroleum plant gas stream or a petrochemical plant gas stream. These methods employ a common new concept which is the use of the turbo-expander shaft compressor to generate the reflux requirement for the cryogenic absorber or distillation columns. The power of the turbo-expander which is absorbed by the shaft compressor is always high enough so that reflux generation by a specific gas compression through the expander shaft compressor and subsequent cooling, condensation and sub-cooling can always be easily maintained. The present invention allows for higher cryogenic absorber pressure and a lower demethanizer/de-ethanizer column pressure thus eliminating the common cryogenic pump at absorber bottom. The present invention ultimately results in a lower residue compression and utilities consumption. The present invention as such allows for a higher 99+% recovery of NGL from the feed gas stream.

13 Claims, 7 Drawing Sheets

ETHANE PLUS AND HHH PROCESS FOR NGL RECOVERY

This application claims benefit of U.S. provisional application Ser. No. 60/500,014 filed Sep. 5, 2003.

BACKGROUND OF THE INVENTION

The present invention relates to processes for recovery of ethane, propane and NGL from natural gas whereby the expander shaft compressor is located in a new locations permitting the reflux generation requirement for the cryogenic absorber and/or gas processing distillation columns.

Current prior art processes for recovery of natural gas liquids comprise:

- A large sales gas export compressor that unnecessarily increases utilities, the large size needed to compensate for a high pressure drop across a turbo expander that provides some process refrigeration and dictating a low cryogenic absorber pressure.
- A relatively high capacity cryogenic pump to pump a bottoms liquid stream from a cryogenic absorber.
- Expander feed gas being at least partly condensed and used as a reflux to a demethanizer, causing loss of propane from a bottoms liquid product.
- Process configuration and operating conditions that might result in a lower ethane plus or propane plus recovery (less than 99%). U.S. Pat. No. 6,581,410 B1.
- Process configuration and operating conditions whereby maximum heat integration between cold and hot streams are not always optimally effected. This results in a lower outlet temperatures of cold streams and accordingly a lower overall UA.
- In propane recovery, relatively large energy consumption in a de-ethanizer bottom reboiler due to operation at pressures higher than a cryogenic absorber.
- In propane recovery, a de-ethanizer must be designed with a relatively large diameter.
- In propane recovery mode, extra equipment must be installed to provide chilling of feed gas through heat exchange with de-ethanizer side draw.
- In ethane recovery, additional multi-flash vessels and LNG multi-stream, platefin heat exchangers are needed to generate multiple reflux streams for an absorber de-methanizer.
- Excess carbon dioxide tends to accumulate an NGL product
- In propane recovery, additional compressors are needed to recycle de-ethanizer overhead gases to a cryogenic absorber, which operates at a pressure above the de-ethanizer. PCT/US01/20633, WO 02/14763, US 2002/0166336 A1.
- In propane recovery, ethane can build up in a gas loop between a de-ethanizer and a cryogenic absorber that makes operation unstable.
- In a propane recovery, lean gas and de-ethanizer OVHD gases are recycled back to the cryogenic absorber. US 2004/0148964 A1, WO 2004/057253 A2.

U.S. Pat. Nos. 6,578,379, 6,278,035, 6,311,516, 6,354,105, 6,453,698, and 6,244,070 generally describe a state of the art using multiple pieces of expensive equipment and/or external refrigeration systems to accomplish high recovery of ethane from NGL. Older references, such as U.S. Pat. Nos. 4,851,020, 4,867,499, and 5,992,175, show ethane recovery systems with somewhat fewer pieces of equipment and less reliance on external refrigeration. The systems in these older references have been found to be incapable of obtaining presently commercially required recovery of ethane from NGL feeds.

Fractionation of the natural gas feed requires that a product stream contain a minimum specified amount of carbon dioxide. Obtaining a low level of carbon dioxide in the product stream has in the past typically required two or more separated fractionation columns processing the natural gas feed.

There is a need for a process that minimizes or eliminates the above problems.

SUMMARY OF THE INVENTION

A first form of the invention for ethane recovery is titled the "Ethane Plus Process".

A second form of the invention for propane recovery is titled "HHH" Process for Propane Recovery".

The present invention comprises processes for very high level recovery of ethane and natural gas liquids ("NGL") from natural gas. The present invention uses an expander shaft compressor combination in a new location in the process flow sheet as compared with a prior art location as a booster compressor for a lean gas stream just prior to its compression by an export gas compressor, or to compress de-methanizer and de-ethanizer top product gases to lean gas pressure or to increase the feed gas pressure upstream the expander. This new application for the expander shaft compressor will include but not limited to the following applications:

- In a propane recovery mode for the process unit, compress de-ethanizer overhead gas and recycle it back, compressed, cooled and expanded as an absorption stream, to a top stage of a cryogenic absorber.
- In an ethane recovery mode for the process unit which employs a single absorber demethanizer tower combination, compress, cool, and recycle part of a product ("sales") gas stream (i.e., also part of an overhead gas stream of a absorber demethanizer tower) as reflux for the absorber demethanizer.
- In an ethane recovery mode for the process unit, compress, cool, and recycle all demethanizer OVHD gas as reflux for the cryogenic absorber (in case of having a dedicated high pressure absorber and a dedicated low pressure demethanizer)
- In a propane recovery mode and/or ethane recovery mode for the process unit, compress and cool part of an overhead gas stream from a cryogenic absorber upstream the absorber OVHD condenser for use as a refrigerant in heat exchange (OVHD condenser) with an overhead gas stream from either the cryogenic absorber demethanizer, a de-ethanizer or demethanizer. This refrigerant after absorbing such heat is returned at the same take-off point at same temperature and pressure to the overhead gas stream from the cryogenic absorber from which it was drawn.
- In a propane recovery mode and/or ethane recovery mode for the process unit, condense and subcool part of an overhead gas stream from a cryogenic absorber (lean gas) for use as a refrigerant in heat exchange (OVHD condenser) with an overhead gas stream from either a de-ethanizer or demethanizer. This refrigerant after absorbing such heat is heated and compressed through the expander shaft compressor with or without residue gas from Deethanizer or demethanizer to be used as a reflux for the cryogenic absorber after being condensed, subcooled and expanded to absorber pressure.

Compress part of the feed gas or the expander feed gas or other gases in the flow sheet to be used as a refrigerant for absorber OVHD condenser or demethanizer OVHD condenser or Deethanizer OVHD condenser. The refrigerant after absorbing the heat load can be returned to an appropriate location in the flow sheet As a result of this new location and service of the expander shaft compressor combination, the following advantages are realized:

In a propane recovery mode for the process unit, the cryogenic absorber operates at a much higher pressure and reduces the export gas compressor size and utilities.

In a propane recovery mode for the process unit, the de-ethanizer operates at a much lower pressure and reduces external reboiling heat requirement, which in turn reduces the required column diameter.

In a propane recovery mode for the process unit, a pump for a bottoms liquid stream from the cryogenic absorber can be eliminated in most cases.

In an ethane recovery mode for the process unit, the demethanizer operates at a much lower pressure, which in turn reduces the required column diameter and eliminates the absorber bottom cryogenic pump. This is in case of having a dedicated high pressure absorber and a dedicated low pressure demethanizer configuration.

Higher ethane and propane recoveries in all mode of operation.

Lower carbon dioxide in NGL product in most of the cases.

Less number of processing equipment e.g., dedicated external feed or recycle compressors, dedicated self refrigeration packages and accessories, multiple cold box and flash vessels and others In these processes, a feed gas is partly condensed and separated into a liquid feed fed to a single column and a vapor part fed to an expander. The expansion of part of the feed gas to power a compressor that compresses a part of the vapor overhead of the column, whereafter the compressed part of the vapor overhead is substantially condensed in at least two side reboilers for the column and a third bottom reboiler. The substantially condensed and compressed stream is flashed and fed to the top tray of the column. These steps to provide reflux to the column result in a highly effective solvent for ethane and NGL recovery from vapor rising through the column. The flashed reflux stream provides so much additional cooling duty to the column that ethane recovery with the invention processes can result in recovery of as much as 99.6 mole percent of the ethane in the feed gas.

An object of the present invention processes is to generate a solvent for ethane and NGL recovery, where the volume of the solvent needed can be varied by increasing or decreasing the portion of the column vapor overhead directed to a compressor connected by shaft to the feed gas expander.

Another object of the invention is to operate the cryogenic absorber at a much higher pressure in order to save power of the export compression. (in case of having a two separate absorber and de-methanizer. The latter is operating at a lower pressure than the absorber)

Another object of the invention is to provide heating duty for two side reboilers for the column from the heat of compression of the recycle part of the absorber demethanizer or all of de-ethanizer or demethanizer overhead vapor stream.

Another object of the invention is to provide a process configuration where carbon dioxide content in the NGL product stream is reduced over the prior art in some cases. This in turn reduces the cost and utilities of carbon dioxide treatment unit downstream of the invention process unit.

"HHH" Process for Propane Recovery

A second form of the invention comprises a process for propane recovery using a cryogenic absorber and a deethanizer. The equipment list is similar to the first form of the invention, in that a sales gas compressor, expander/compressor and two air coolers are used. A feed gas is partly condensed, with the liquid part being further cooled and fed to a deethanizer and the vapor part being expanded and fed to a lowest stage of a cryogenic absorber. An overhead gas stream from the absorber becomes the product gas stream. A solvent stream for the absorber is formed from the overhead gas stream from the deethanizer after compression via expander shaft compressor, air cooling and flashing to absorber pressure. The evaporative effect of the solvent stream increases the fractionation effect of the absorber.

The single expander is preferably (typical to given case) operated with an intake stream at about −40 degrees C. or lower, where the process benefits in that the condensation of ethane and heavier components will be effectively brought to the bottom product stream of the column.

The single column (i.e., a cryogenic absorber) is preferably (typical to given case) operated at 37 Barg or higher, as it has been found that it improves recovery of ethane and heavier components from the expander outlet gas portion and reduces buildup of ethane in recycle streams, as well as reducing the substantial size and utility requirements of the sales gas compressor.

BRIEF DESCRIPTION OF THE DRAWINGS

The application and advantages of the present invention will become more apparent by referring to the following detailed schemes

DETAILED DESCRIPTION OF THE INVENTION

Figure 1:
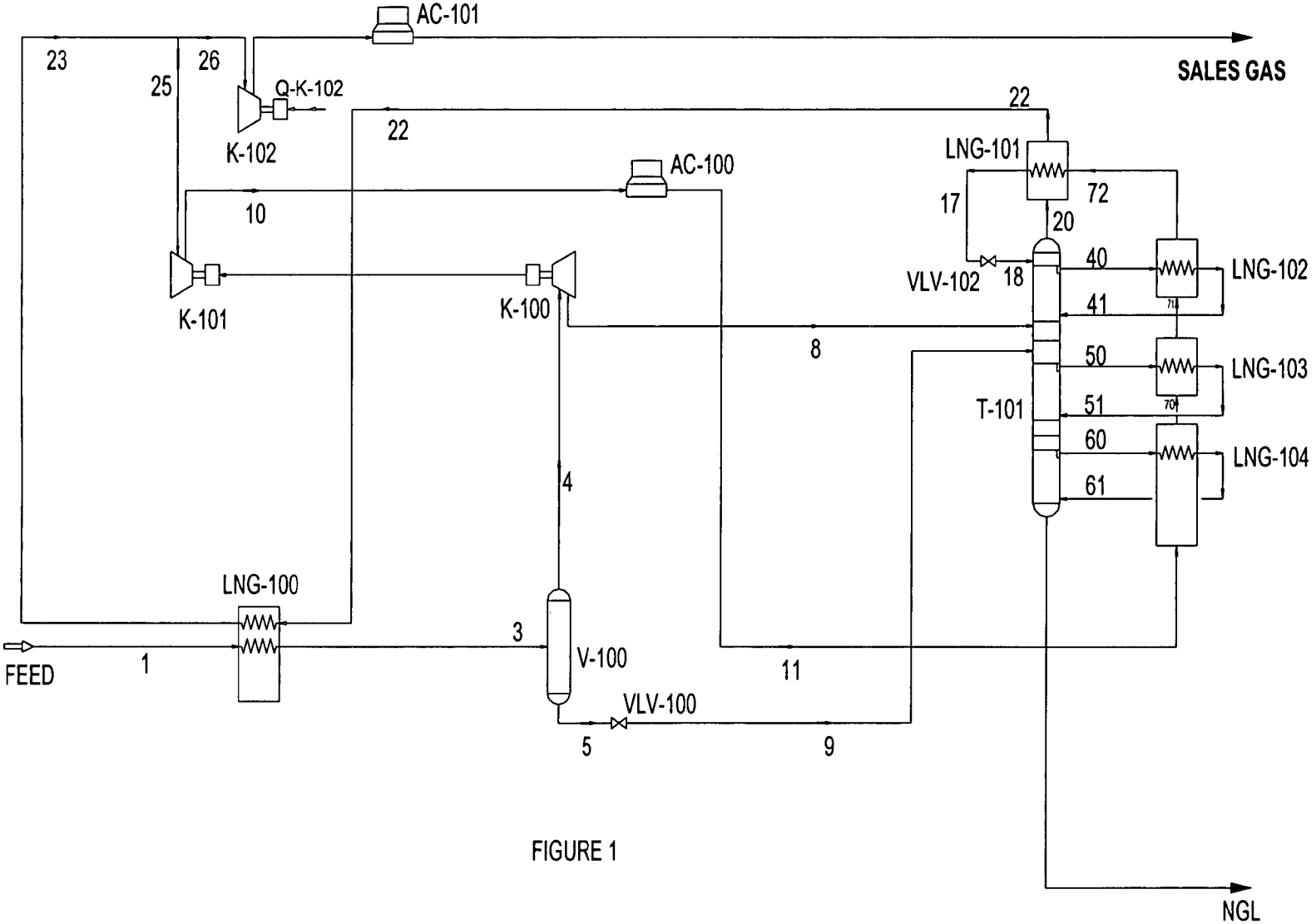
FIG. 1 is a flow sheet of a first case for the first form of the invention for ethane recovery using a single absorber demethanizer tower.
Figure 2:
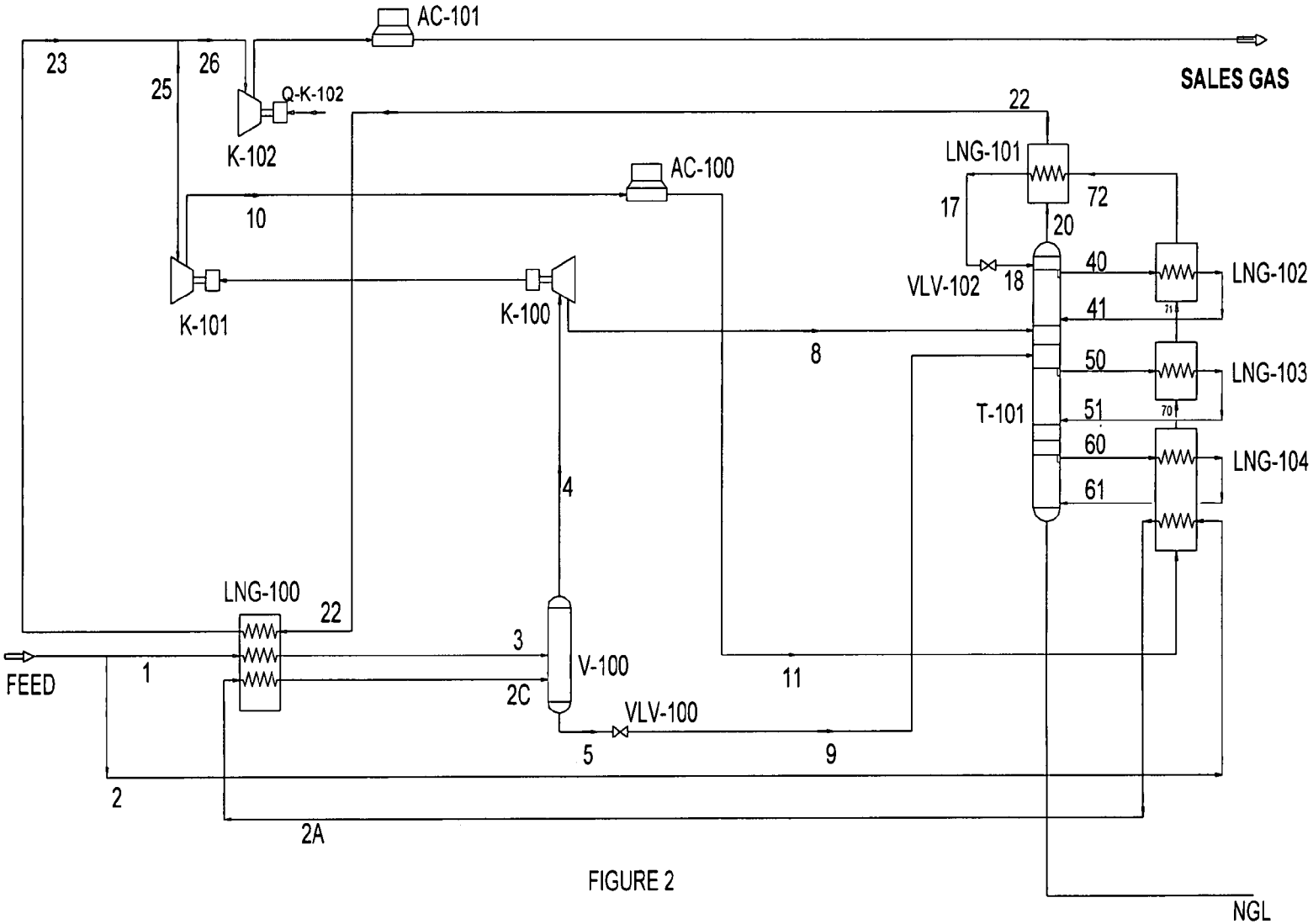
FIG. 2 is a flow sheet of second and third cases for the first form of the invention for ethane recovery for the same feed composition as processed by the invention of FIG. 1.

The item numbers of FIGS. 1 and 2 represent similar process streams and equipment as appropriate. The item numbers of FIG. 3 refer only to that figure's description below and to the Case 4 shown in Table 4. The present invention comprises a number of cases. Case 1 corresponds to Table 1 below and FIG. 1. Case 2 corresponds to Table 2 below and FIG. 2. Case 3 corresponds to Table 3 below and FIG. 2. Case 4 corresponds to Table 4 below and FIG. 3. Cases 1–3 are directed to an ethane recovery process ("Ethane Plus Process") with reduced equipment cost and utilities requirements. Case 4 is directed to a propane recovery process ("HHH" Process) with reduced equipment cost and utilities requirements.

FIGS. 1 and 2, and their corresponding processes, are substantially the same except that in FIG. 2 a portion of the feed gas 1 is cooled in exchanger LNG-104 and exchanger LNG-100 before being delivered to the high pressure separator V-100. Several pieces of heat transfer equipment are identified with the prefix "LNG-", which indicates the presence of a multistream heat exchanger. The particular advantages of these exchangers may appreciated with a review of Tables 1–3 for those pieces of equipment, in that relatively close approach temperatures are easily attained, as is well known in the art.

FIG. 1 shows a feed gas stream 1 being cooled in exchanger LNG-100, forming stream 3, which is in turn separated in vessel V-100, a high pressure separator. Vapor stream 4 is expanded in expander K-100 to form stream 8. Stream 8 is fed to column T-101, a column with in a specific form about 25 theoretical stages. Stream 5 is withdrawn from vessel V-100 and flashed across valve VLV-100 to form stream 9. Streams 8 and 9 are fed to column T-101, in a specific example, at stages 7 and 14 of column T-101. Column T-101 comprises at least two side reboiler exchangers LNG-102 and LNG-103 which respectively take streams 40 and 50 from stages 11 and 15, heat them and return the heated streams 41 and 51 to stages 12 and 16. A bottom reboiler exchanger LNG-103 heats stream 60 to form stream 61. Column T-101 produces an overhead vapor stream 20 that is heated in exchanger LNG-101 to form stream 22 and a bottoms liquid stream NGL that is the NGL product stream for this process. Vapor stream 22 is heated in exchange LNG-100 to cool feed gas stream 1, producing a vapor stream 23 that is split to form a first vapor stream 26, compressed in compressor K-102 and cooled in air cooler AC-101 to form this process' sales gas stream, and a second vapor stream 25 that is compressed in compressor K-101 via the expansion energy of expander K-100 (the invention part of the flowsheet). Stream 25 thereafter forms stream 10, which is cooled in air cooler AC-100 to form stream 11. Stream 11 is cooled sequentially in exchangers LNG-104, LNG-103, LNG-102 and LNG-101 respectively forming streams 70, 71, 72 and 17. Stream 17 is flashed at valve VLV-102 into column T-101 to form the sole reflux stream for column T-101.

The process shown in FIG. 1 and whose data appears in Table 1 obtains approximately 99.3 mole percent recovery of stream 1 ethane. It has been found that, as compared with prior art processes, carbon dioxide is reduced in the NGL product stream NGL. The processes of Cases 1–3, i.e., FIGS. 1 and 2, use a single fractionation column for ethane absorption as well as NGL production. The composition and volume of solvent used for capturing ethane and NGL can be changed with varying the flow rate of stream 25 to increase or decrease recycle. In addition, all the reboiling requirements of column T-101 are effectively recovered to the process primarily to generate reflux and solvent for column T-101.

FIG. 2 is substantially the same in description and process except that the stream FEED is split into streams 1 and stream 2. Stream 2 is cooled in exchanger LNG-104 in indirect heat transfer with stream 60, cooling in that exchanger along with stream 11. The cooled stream 2, i.e., stream 2A, is further cooled in exchanger LNG-100 with stream 1, with streams 2C and 3 being formed respectively for separation in vessel V-100. This apparently small change in process stream heat integration produces surprising results.

The recovery of ethane for Cases 2 and 3 are about 99.4 mole percent and 99.6 mole percent respectively. Case 1 and Case 2 require cooling so that stream 5 is cooled to about −46 degrees C. Case 3 requires cooling so that stream 5 is about −48 degrees C. This small change requires the appropriate process modifications shown in the tables, where Case 3 is shown to be superior in recovering heavier components over Cases 1 and 2. Column T-110 pressure is also different as to the Cases 1–3, where in Cases 1 and 3 the pressure is 23.5 Barg and 24.5 Barg in Case 2.

Column T-101, for Cases 1, 2 and 3 respectively operates with an overhead stream 20 temperature of −102.2 degrees C., −101.1 degrees C., and −102.4 degrees C. at pressures of 23 Barg, 24 Barg, and 23 Barg. At these conditions, stream 20 is almost ethane free.

In Case 1, recycle gas stream 10 is cooled in the air cooler to about 66 degrees C., sufficient for reboiling column T-101. For Cases 2 and 3, recycle gas stream 10 is be cooled in the air cooler to about 40 degrees C., sufficient to provide the reboiling duty for T-101 in those cases in addition to heat load provided by part of the feed gas stream. Cold residue recycle gas stream 72 is further condensed and sub cooled by exchange with cold stream 20 in exchanger LNG-101. Product sales gas is compressed to 62.75 Barg. This configuration provides, in addition to high ethane recovery and less CO2 in NGL product, a less number of processing equipment like cold boxes and flash vessels.

Figure 3:
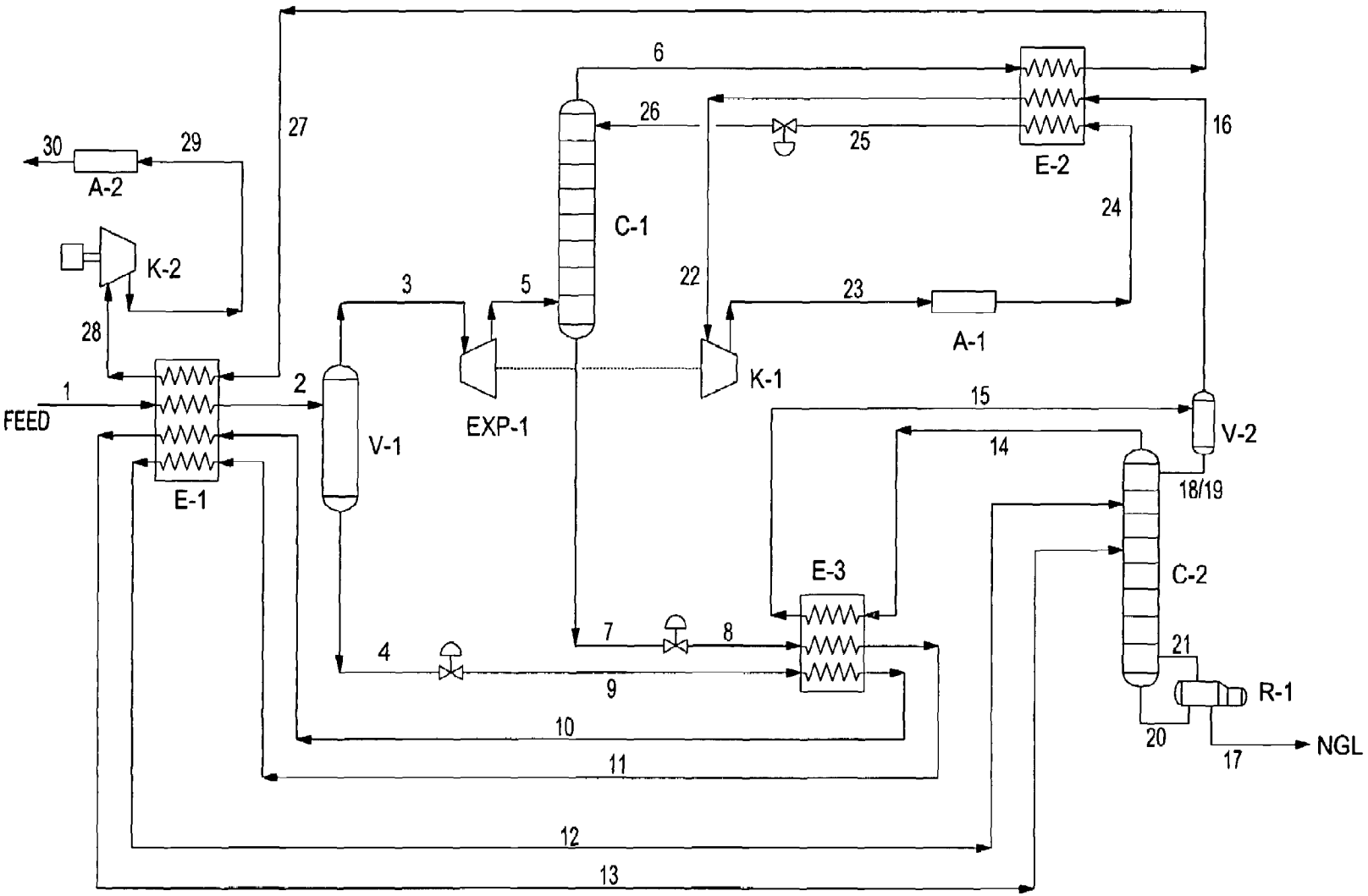
FIG. 3 is a flow sheet of a fourth case of the second form of the invention for propane recovery from a rich gas feed stream using a high pressure cryogenic absorber and a low pressure de-ethanizer.

Case 4 is shown in FIG. 3 and its operating data shown in Table 4. Case 4 is for propane recovery. Feed gas 1 is cooled in exchanger E-1 against streams 27, 10 and 11 to form stream 2, a partly condensed stream separated in vessel V-1 to form a vapor stream 3 and a liquid stream 4. Stream 4 is flashed to form stream 9, which is cooled in exchanger E-3 and exchanger E-1 respectively to form streams 10 and 13. Stream 13 is fed to a mid stage of deethanizer column C-2. Column C-2 produces an overhead vapor stream 14 that is cooled in exchanger E-3 to form stream 15, which is separated into vapor and liquid streams 16 and 18/19. Stream 18/19 is the entire reflux for column C-2. A bottom liquid stream 20 of column C-2 is split to form reboiling stream 21 and NGL product stream 17.

In FIG. 3, vapor stream 16 is heated in exchanger E-2, compressed in compressor K-1, cooled in exchanger A-1, cooled in exchanger E-2, and flashed across a valve to respectively form streams 22, 23, 24, 25 and 26. Stream 26 forms the sole absorption solvent stream for cryogenic absorber C-1, which contacts the vapor part of stream 5 in absorber C-1. The overhead vapor stream 6 of absorber C-1 is heated in exchanger E-2, heated in exchanger E-1, compressed in compressor K-2, and cooled in air cooled exchanger A-2 to respectively form streams 27, 28, 29, and 30 to deliver a sales gas product stream. Stream 3 from vessel V-1 is expanded in expander EXP-1 to form steam 5, which is fed to the bottom of absorber C-1. The sole energy used to drive compressor K-1 is from the shaft energy from expander EXP-1.

Figure 4:
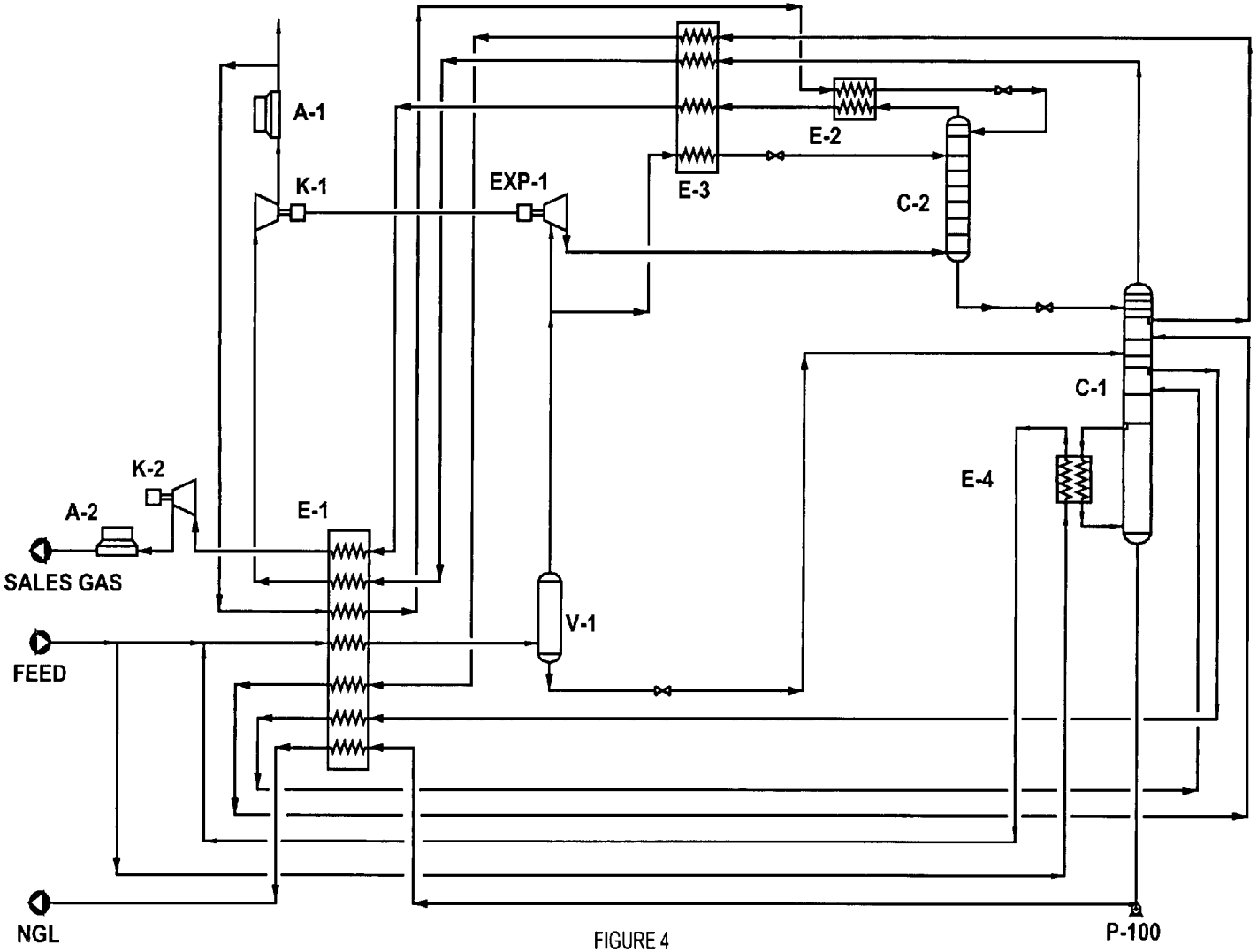
FIG. 4 is a generalized flow sheet of a fifth case of the invention.

FIG. 4 shows a second case of the second form of the invention for ethane recovery. Two separate columns, cryogenic absorber C-1 and de-methanizer C-2, are used. A de-methanizer top gas is heated in a series of heat exchangers E-3 and E-1 and is compressed via expander shaft compressor. Compressed gas is then returned as a reflux to column C-2 top tray after being cooled, condensed, sub-cooled (in E-2) and throttled in pressure to absorber pressure.

Figure 5:
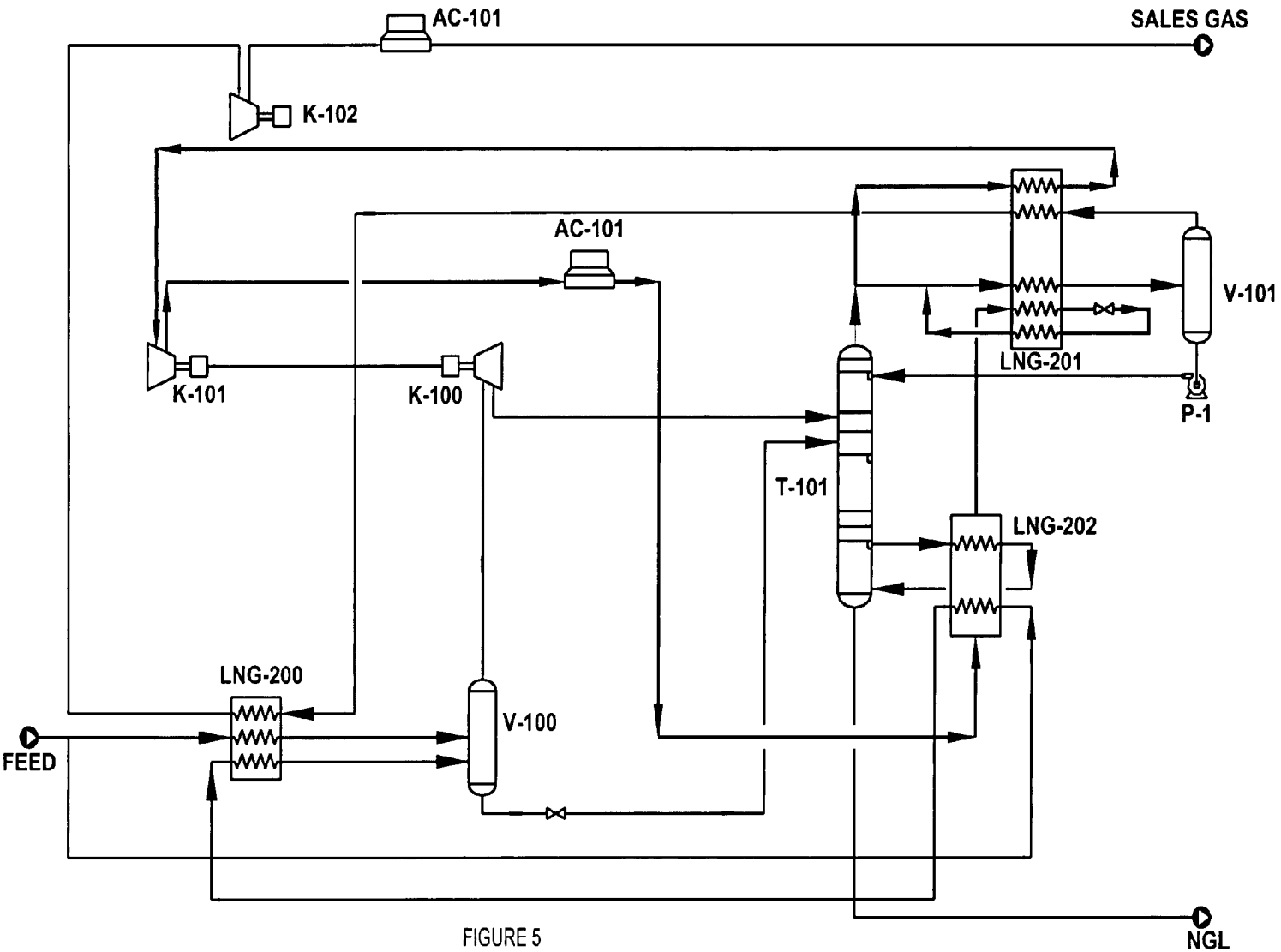
FIG. 5 is a generalized flow sheet of a sixth case of the invention.

FIG. 5 shows a fourth case of the first form of the invention for ethane recovery. In this case the expander shaft compressor K-100/K-101 is used to used to provide the power requirement of an internal refrigeration system. A slip stream from column T-101 overhead is heated and compressed in expander shaft compressor K-100/K-101. It is then cooled, condensed and sub-cooled at high pressure. The stream is then throttled to a pressure just above a take off point pressure. Throttling generates refrigeration which allows the mixture to be used as a refrigerant to provide the cooling and reflux generation in the column T-101 OVHD condenser system. The mixture after heating is returned to same take off point at same pressure and temperature.

Figure 6:
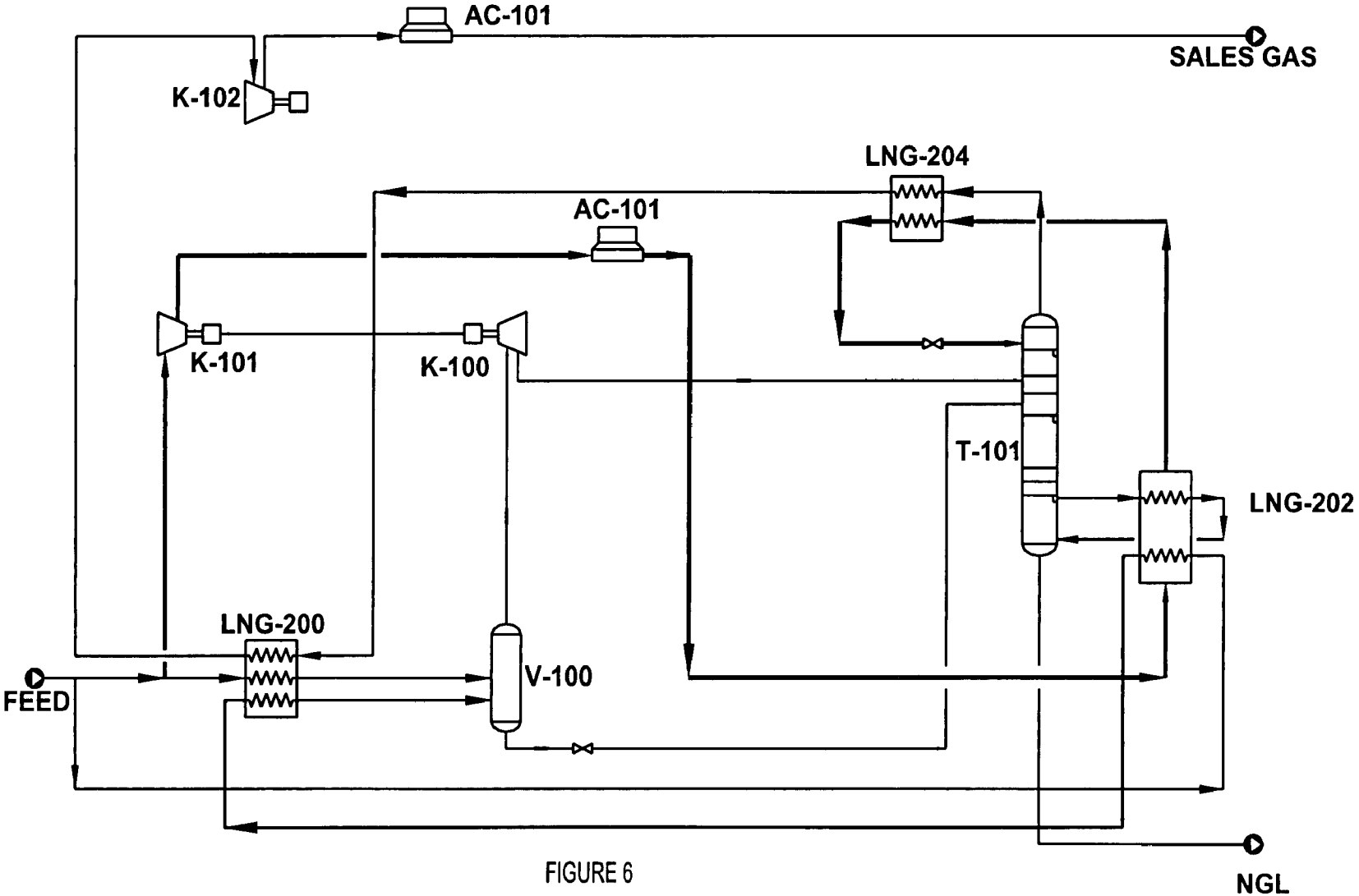
FIG. 6 is a generalized flow sheet of a seventh case of the invention.

FIG. 6 shows a fifth case of the first form of the invention for ethane recovery. In this case, a slip stream of the feed is compressed via the expander shaft compressor K-100/K-101 and is then used as a reflux for column T-101 after being cooled, condensed, sub-cooled and throttled to column pressure. The mixture from the feed expander is then directed to a mid point in the column T-101 top section.

Figure 7:
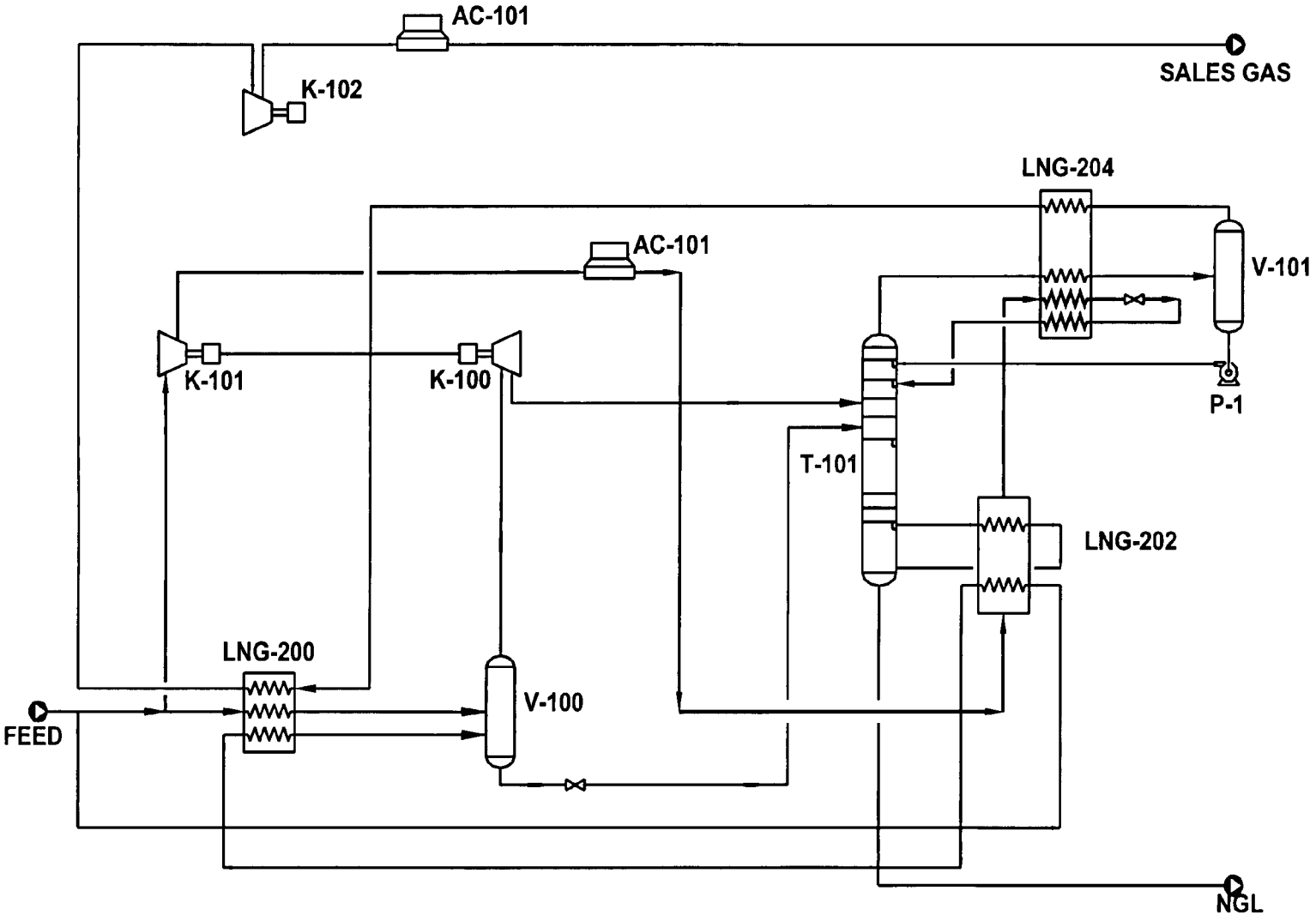

FIG. 7 shows a sixth case of the first form of the invention for ethane recovery. In this case, expander shaft compressor K-100/K-101 is used to provide the overhead condenser duty of column T101 absorber de-methanizer column. An open loop, self refrigeration system is made via compressing part of the feed gas stream. The refrigerant after heat exchange in the OVHD condenser is directed to a middle point of the top section of the absorber de-methanizer.

The above design options will sometimes present the skilled designer with considerable and wide ranges from which to choose appropriate apparatus, conditions, compositions and method modifications for the above examples. However, the objects of the present invention will still be obtained by that skilled designer applying such design options in an appropriate manner.

TABLE 1

Case 1 - Ethane Plus Process. 99.3% Ethane Recovery

| Streams Name | Feed | NGL | Sales Gas |
|---|---|---|---|
| Vapor Fraction | 1 | 0 | 1 |
| Temperature (C) | 24 | 23.14 | 40 |
| Pressure (bar_g) | 60.99 | 23.3 | 62.25 |
| Molar Flow (kgmole/h) | 1.50E+04 | 1479 | 1.35E+04 |
| Mass Flow (kg/h) | 2.79E+05 | 6.07E+04 | 2.19E+05 |
| Comp Molar Flow (CO2) (kgmole/h) | 74.97 | 38.7753 | 36.1871 |
| Comp Molar Flow (Nitrogen) (kgmole/h) | 52.485 | 0 | 52.485 |
| Comp Molar Flow (Methane) (kgmole/h) | 13434.63 | 8.3602 | 13426.2876 |
| Comp Molar Flow (Ethane) (kgmole/h) | 788.685 | 782.7796 | 5.8858 |
| Comp Molar Flow (Propane) (kgmole/h) | 356.85 | 356.849 | 0 |
| Comp Molar Flow (i-Butane) (kgmole/h) | 80.97 | 80.9699 | 0 |
| Comp Molar Flow (n-Butane) (kgmole/h) | 98.955 | 98.955 | 0 |
| Comp Molar Flow (i-Pentane) (kgmole/h) | 35.985 | 35.985 | 0 |
| Comp Molar Flow (n-Pentane) (kgmole/h) | 28.485 | 28.485 | 0 |
| Comp Molar Flow (n-Hexane) (kgmole/h) | 28.485 | 28.485 | 0 |
| Comp Molar Flow (n-Heptane) (kgmole/h) | 15 | 15 | 0 |
| Comp Molar Flow (n-Octane) (kgmole/h) | 4.5 | 4.5 | 0 |

| Streams Name | 3 | 4 | 5 | 8 | 9 |
|---|---|---|---|---|---|
| Vapor Fraction | 0.8994 | 1 | 0 | 0.9039 | 0.3701 |
| Temperature (C) | −46 | −46 | −46 | −85.14 | −69.8 |
| Pressure (bar_g) | 60.49 | 60.49 | 60.49 | 23.5 | 23.5 |
| Molar Flow (kgmole/h) | 1.50E+04 | 1.35E+04 | 1509 | 1.35E+04 | 1509 |
| Mass Flow (kg/h) | 2.79E+05 | 2.35E+05 | 4.44E+04 | 2.35E+05 | 4.44E+04 |
| Comp Molar Flow (CO2) (kgmole/h) | 74.97 | 64.1046 | 10.8654 | 64.1046 | 10.8654 |
| Comp Molar Flow (Nitrogen) (kgmole/h) | 52.485 | 51.1377 | 1.3473 | 51.1377 | 1.3473 |
| Comp Molar Flow (Methane) (kgmole/h) | 13434.63 | 12540.2794 | 894.3506 | 12540.3 | 894.351 |
| Comp Molar Flow (Ethane) (kgmole/h) | 788.685 | 594.0489 | 194.6361 | 594.049 | 194.636 |
| Comp Molar Flow (Propane) (kgmole/h) | 356.85 | 179.9304 | 176.9196 | 179.93 | 176.92 |
| Comp Molar Flow (i-Butane) (kgmole/h) | 80.97 | 26.2151 | 54.7549 | 26.2151 | 54.7549 |

TABLE 1-continued

| Case 1 - Ethane Plus Process. 99.3% Ethane Recovery | | | | | |
|---|---|---|---|---|---|
| Comp Molar Flow (n-Butane) (kgmole/h) | 98.955 | 25.4446 | 73.5104 | 25.4446 | 73.5104 |
| Comp Molar Flow (i-Pentane) (kgmole/h) | 35.985 | 5.1288 | 30.8562 | 5.1288 | 30.8562 |
| Comp Molar Flow (n-Pentane) (kgmole/h) | 28.485 | 3.1534 | 25.3316 | 3.1534 | 25.3316 |
| Comp Molar Flow (n-Hexane) (kgmole/h) | 28.485 | 1.2804 | 27.2046 | 1.2804 | 27.2046 |
| Comp Molar Flow (n-Heptane) (kgmole/h) | 15 | 0.2725 | 14.7275 | 0.2725 | 14.7275 |
| Comp Molar Flow (n-Octane) (kgmole/h) | 4.5 | 0.0327 | 4.4673 | 0.0327 | 4.4673 |
| Streams Name | 10 | 11 | 17 | 18 | 20 |
| Vapor Fraction | 1 | 1 | 0 | 0 | 1 |
| Temperature (C) | 97.92 | 66 | −100.7 | −102.6 | −102.2 |
| Pressure (bar_g) | 50.37 | 49.87 | 47.87 | 23.5 | 23 |
| Molar Flow (kg mole/h) | 4270 | 4270 | 4270 | 4270 | 1.78E+04 |
| Mass Flow (kg/h) | 6.90E+04 | 6.90E+04 | 6.90E+04 | 6.90E+04 | 2.88E+05 |
| Comp Molar Flow (CO2) (kgmole/h) | 11.428 | 11.428 | 11.428 | 11.428 | 47.6146 |
| Comp Molar Flow (Nitrogen) (kgmole/h) | 16.5742 | 16.5742 | 16.5742 | 16.5742 | 69.0592 |
| Comp Molar Flow (Methane) (kgmole/h) | 4239.8937 | 4239.8937 | 4239.8937 | 4239.89 | 17666.2 |
| Comp Molar Flow (Ethane) (kgmole/h) | 1.859 | 1.859 | 1.859 | 1.859 | 7.7445 |
| Comp Molar Flow (Propane) (kgmole/h) | 0 | 0 | 0 | 0 | 0 |
| Comp Molar Flow (i-Butane) (kgmole/h) | 0 | 0 | 0 | 0 | 0 |
| Comp Molar Flow (n-Butane) (kgmole/h) | 0 | 0 | 0 | 0 | 0 |
| Comp Molar Flow (i-Pentane) (kgmole/h) | 0 | 0 | 0 | 0 | 0 |
| Comp Molar Flow (n-Pentane) (kgmole/h) | 0 | 0 | 0 | 0 | 0 |
| Comp Molar Flow (n-Hexane) (kgmole/h) | 0 | 0 | 0 | 0 | 0 |
| Comp Molar Flow (n-Heptane) (kgmole/h) | 0 | 0 | 0 | 0 | 0 |
| Comp Molar Flow (n-Octane) (kgmole/h) | 0 | 0 | 0 | 0 | 0 |
| Streams Name | 22 | 23 | 24 | 25 | 26 |
| Vapor Fraction | 1 | 1 | 1 | 1 | 1 |
| Temperature (C) | −76.12 | 22.17 | 22.17 | 22.17 | 117.8 |
| Pressure (bar_g) | 22.5 | 22 | 22 | 22 | 62.75 |
| Molar Flow (kgmole/h) | 1.78E+04 | 1.78E+04 | 1.35E+04 | 4270 | 1.35E+04 |
| Mass Flow (kg/h) | 2.88E+05 | 2.88E+05 | 2.19E+05 | 6.90E+04 | 2.192+05 |
| Comp Molar Flow (CO2) (kgmole/h) | 47.6146 | 47.6146 | 36.1871 | 11.4275 | 36.1871 |
| Comp Molar Flow (Nitrogen) (kgmole/h) | 69.0592 | 69.0592 | 52.485 | 16.5742 | 52.485 |
| Comp Molar Flow (Methane) (kgmole/h) | 17666.1678 | 17666.1678 | 13426.2876 | 4239.88 | 13426.3 |
| Comp Molar Flow (Ethane) (kgmole/h) | 7.7445 | 7.7445 | 5.8858 | 1.8587 | 5.8858 |
| Comp Molar Flow (Propane) (kgmole/h) | 0 | 0 | 0 | 0 | 0 |
| Comp Molar Flow (i-Butane) (kgmole/h) | 0 | 0 | 0 | 0 | 0 |
| Comp Molar Flow (n-Butane) (kgmole/h) | 0 | 0 | 0 | 0 | 0 |
| Comp Molar Flow (i-Pentane) (kgmole/h) | 0 | 0 | 0 | 0 | 0 |
| Comp Molar Flow (n-Pentane) (kgmole/h) | 0 | 0 | 0 | 0 | 0 |
| Comp Molar Flow (n-Hexane) (kgmole/h) | 0 | 0 | 0 | 0 | 0 |
| Comp Molar Flow (n-Heptane) (kgmole/h) | 0 | 0 | 0 | 0 | 0 |
| Comp Molar Flow (n-Octane) (kgmole/h) | 0 | 0 | 0 | 0 | 0 |

TABLE 1-continued

Case 1 - Ethane Plus Process. 99.3% Ethane Recovery

| Streams<br>Name | 40 | 41 | 50 | 51 | 61 |
|---|---|---|---|---|---|
| Vapor Fraction | 0 | 0.278 | 0 | 0.2571 | 0.3258 |
| Temperature (C) | −68.99 | −49.91 | −41.56 | −15.26 | 23.14 |
| Pressure (bar_g) | 23.13 | 23.13 | 23.18 | 22.68 | 23.3 |
| Molar Flow (kgmole/h) | 2148 | 2148 | 2503 | 2503 | 2194 |
| Mass Flow (kg/h) | 5.91E+04 | 5.91E+04 | 8.60E+04 | 8.60E+04 | 8.46E+04 |
| Comp Molar Flow (CO2) (kgmole/h) | 120.4741 | 120.4741 | 104.4713 | 104.471 | 91.9275 |
| Comp Molar Flow (Nitrogen) (kgmole/h) | 0.1403 | 0.1403 | 0.0342 | 0.0342 | 0 |
| Comp Molar Flow (Methane) (kgmole/h) | 840.6142 | 840.6142 | 522.732 | 522.732 | 29.7185 |
| Comp Molar Flow (Ethane) (kgmole/h) | 928.8846 | 928.8846 | 1177.4388 | 1177.44 | 1310.5 |
| Comp Molar Flow (Propane) (kgmole/h) | 195.231 | 195.231 | 398.8125 | 398.813 | 446.51 |
| Comp Molar Flow (i-Butane) (kgmole/h) | 26.8529 | 26.8529 | 84.5485 | 84.5485 | 91.0065 |
| Comp Molar Flow (n-Butane) (kgmole/h) | 25.8084 | 25.8084 | 101.9202 | 101.92 | 108.36 |
| Comp Molar Flow (i-Pentane) (kgmole/h) | 5.1443 | 5.1443 | 36.3722 | 36.3722 | 37.6766 |
| Comp Molar Flow (n-Pentane) (kgmole/h) | 3.1571 | 3.1571 | 28.6936 | 28.6936 | 29.5609 |
| Comp Molar Flow (n-Hexane) (kgmole/h) | 1.2785 | 1.2785 | 28.5104 | 28.5104 | 28.9284 |
| Comp Molar Flow (n-Heptane) (kgmole/h) | 0.2719 | 0.2719 | 14.9842 | 14.9842 | 15.0996 |
| Comp Molar Flow (n-Octane) (kgmole/h) | 0.0326 | 0.0326 | 4.4924 | 4.4924 | 4.5129 |

| Streams<br>Name | 70 | 71 | 72 | Btm-Reb Feed |
|---|---|---|---|---|
| Vapor Fraction | 1 | 1 | 1 | 0 |
| Temperature (C) | 15.24 | −40.06 | −67.49 | 12.66 |
| Pressure (bar_g) | 49.37 | 48.87 | 48.37 | 23.3 |
| Molar Flow (kgmole/h) | 4270 | 4270 | 4270 | 2194 |
| Mass Flow (kg/h) | 6.90E+04 | 6.90E+04 | 6.90E+04 | 8.46E+04 |
| Comp Molar Flow (CO2) (kgmole/h) | 11.428 | 11.428 | 11.428 | 91.9275 |
| Comp Molar Flow (Nitrogen) (kgmole/h) | 16.5742 | 16.5742 | 16.5742 | 0 |
| Comp Molar Flow (Methane) (kgmole/h) | 4239.8937 | 4239.8937 | 4239.8937 | 29.7185 |
| Comp Molar Flow (Ethane) (kgmole/h) | 1.859 | 1.859 | 1.859 | 1310.5 |
| Comp Molar Flow (Propane) (kgmole/h) | 0 | 0 | 0 | 446.51 |
| Comp Molar Flow (i-Butane) (kgmole/h) | 0 | 0 | 0 | 91.0065 |
| Comp Molar Flow (n-Butane) (kgmole/h) | 0 | 0 | 0 | 108.36 |
| Comp Molar Flow (i-Pentane) (kgmole/h) | 0 | 0 | 0 | 37.6766 |
| Comp Molar Flow (n-Pentane) (kgmole/h) | 0 | 0 | 0 | 29.5609 |
| Comp Molar Flow (n-Hexane) (kgmole/h) | 0 | 0 | 0 | 28.9284 |
| Comp Molar Flow (n-Heptane) (kgmole/h) | 0 | 0 | 0 | 15.0996 |
| Comp Molar Flow (n-Octane) (kgmole/h) | 0 | 0 | 0 | 4.5129 |

| LNGs<br>Name | LNG-100 | LNG-101 | LNG-102 | LNG-103 | LNG-104 |
|---|---|---|---|---|---|
| LMTD (C) | 7.369 | 5.986 | 3.77 | 8.409 | 14.19 |
| UA (Calculated) (kJ/C-h) | 9.31 E+06 | 3.82E+06 | 1.77E+06 | 1.24E+06 | 6.34E+05 |
| Hot Pinch Temperature (C) | 24 | −100.7 | −67.49 | −40.06 | 15.24 |
| Cold Pinch Temperature (C) | 22.17 | −102.2 | −68.99 | −41.56 | 12.66 |
| Exchanger Cold Duty (kcal/h) | 1.64E+07 | 5.46E+06 | 1.60E+06 | 2.50E+06 | 2.15E+06 |
| Minimum Approach (C) | 1.829 | 1.5 | 1.5 | 1.5 | 2.578 |

TABLE 1-continued

| Case 1 - Ethane Plus Process. 99.3% Ethane Recovery | | |
|---|---|---|
| Air coolers | | |
| Name | AC-100 | AC-101 |
| Duty (kcal/h) | −1.36E+06 | −1.08E+07 |
| Compressors | | |
| Name | K-101 | K-102 |
| Adiabatic Efficiency | 78 | 80 |
| Polytropic Efficiency | 80 | 82 |
| Capacity (act feed vol flow) (ACT_m3/h) | 4326 | 1.37E+04 |
| Polytropic Head (m) | 1.33E+04 | 1.74E+04 |
| Adiabatic Head (m) | 1.30E+04 | 1.70E+04 |
| Feed Pressure (bar_g) | 22 | 22 |
| Product Pressure (bar_g) | 50.37 | 62.75 |
| Feed Temperature (C) | 22.17 | 22.17 |
| Product Temperature (C) | 97.92 | 117.8 |
| Energy (kW) | 3131 | 1.26E+04 |
| Expanders | | |
| Name | K-100 | |
| Feed Pressure (bar_g) | 60.49 | |
| Product Pressure (bar_g) | 23.5 | |
| Feed Temperature (C) | −46 | |
| Product Temperature (C) | −85.14 | |
| Energy (kW) | 3131 | |
| Adiabatic Efficiency | 85 | |
| Reboiled Absorbers | | |
| Name | T-101 | |
| Number of Trays | 25 | |
| Separators | | |
| Name | V-100 | |
| Vessel Temperature (C) | −46 | |
| Vessel Pressure (bar_g) | 60.49 | |
| Vessel Diameter (m) | 1.981 | |
| Vessel Length or Height (m) | 6.934 | |
| Valves | | |
| Name | VLV-100 | VLV-102 |
| Feed Pressure (bar_g) | 60.49 | 47.87 |
| Product Pressure (bar_g) | 23.5 | 23.5 |
| Molar Flow (kgmole/h) | 1509 | 4270 |
| Volume Flow (m3/h) | 106.3 | 228.5 |

TABLE 2

| Case 2 - Ethane Plus Process. 99.4% Ethane Recovery | | | |
|---|---|---|---|
| Name | Feed | Sales Gas | NGL |
| Vapor Fraction | 1 | 1 | 0 |
| Temperature (C) | 24 | 40 | 25.17 |
| Pressure (bar_g) | 60.99 | 62.25 | 24.3 |
| Molar Flow (kgmole/h) | 1.50E+04 | 1.35E+04 | 1482 |
| Mass Flow (kg/h) | 2.79E+05 | 2.19E+05 | 6.08E+04 |
| Comp Molar Flow (CO2) (kgmole/h) | 74.97 | 34.5299 | 40.4385 |
| Comp Molar Flow (Nitrogen) (kgmole/h) | 52.485 | 52.4849 | 0 |
| Comp Molar Flow (Methane) (kgmole/h) | 13434.63 | 13426.2602 | 8.3597 |
| Comp Molar Flow (Ethane) (kgmole/h) | 788.685 | 5.0341 | 783.6695 |
| Comp Molar Flow (Propane) (kgmole/h) | 356.85 | 0 | 356.8553 |
| Comp Molar Flow (i-Butane) (kgmole/h) | 80.97 | 0 | 80.9706 |

TABLE 2-continued

| Case 2 - Ethane Plus Process. 99.4% Ethane Recovery | | | |
|---|---|---|---|
| Comp Molar Flow (n-Butane) (kgmole/h) | 98.955 | 0 | 98.9556 |
| Comp Molar Flow (i-Pentane) (kgmole/h) | 35.985 | 0 | 35.9851 |
| Comp Molar Flow (n-Pentane) (kgmole/h) | 28.485 | 0 | 28.4851 |
| Comp Molar Flow (n-Hexane) (kgmole/h) | 28.485 | 0 | 28.485 |
| Comp Molar Flow (n-Heptane) (kgmole/h) | 15 | 0 | 15 |
| Comp Molar Flow (n-Octane) (kgmole/h) | 4.5 | 0 | 4.5 |

| Streams Name | 1 | 2 | 2a | 2b | 2c |
|---|---|---|---|---|---|
| Vapor Fraction | 1 | 1 | 0.9997 | 0.9997 | 0.8994 |
| Temperature (C) | 24 | 24 | 16.3 | 16.3 | −46 |
| Pressure (bar_g) | 60.99 | 60.99 | 60.74 | 60.74 | 60.49 |
| Molar Flow (kgmole/h) | 3000 | 1.20E+04 | 1.20E+04 | 1.20E+04 | 1.20E+04 |
| Mass Flow (kg/h) | 5.59E+04 | 2.24E+05 | 2.24E+05 | 2.24E+05 | 2.24E+05 |
| Comp Molar Flow (CO2) (kgmole/h) | 14.994 | 59.976 | 59.976 | 59.976 | 59.976 |
| Comp Molar Flow (Nitrogen) (kgmole/h) | 10.497 | 41.988 | 41.988 | 41.988 | 41.988 |
| Comp Molar Flow (Methane) (kgmole/h) | 2686.926 | 10747.704 | 10747.704 | 10747.704 | 10747.704 |
| Comp Molar Flow (Ethane) (kgmole/h) | 157.737 | 630.948 | 630.948 | 630.948 | 630.948 |
| Comp Molar Flow (Propane) (kgmole/h) | 71.37 | 285.48 | 285.48 | 285.48 | 285.48 |
| Comp Molar Flow (i-Butane) (kgmole/h) | 16.194 | 64.776 | 64.776 | 64.776 | 64.776 |
| Comp Molar Flow (n-Butane) (kgmole/h) | 19.791 | 79.164 | 79.164 | 79.164 | 79.164 |
| Comp Molar Flow (i-Pentane) (kgmole/h) | 7.197 | 28.788 | 28.788 | 28.788 | 28.788 |
| Comp Molar Flow (n-Pentane) (kgmole/h) | 5.697 | 22.788 | 22.788 | 22.788 | 22.788 |
| Comp Molar Flow (n-Hexane) (kgmoe/h) | 5.697 | 22.788 | 22.788 | 22.788 | 22.788 |
| Comp Molar Flow (n-Heptane) (kgmole/h) | 3 | 12 | 12 | 12 | 12 |
| Comp Molar Flow (n-Octane) (kgmole/h) | 0.9 | 3.6 | 3.6 | 3.6 | 3.6 |

| Name | 3 | 4 | 5 | 8 | 9 |
|---|---|---|---|---|---|
| Vapor Fraction | 0.8994 | 1 | 0 | 0.9062 | 0.3615 |
| Temperature (C) | −46 | −46 | −46 | −83.75 | −68.91 |
| Pressure (bar_g) | 60.49 | 60.49 | 60.49 | 24.5 | 24.5 |
| Molar Flow (kgmole/h) | 3000 | 1.35E+04 | 1509 | 1.35E+04 | 1509 |
| Mass Flow (kg/h) | 5.59E+04 | 2.35E+05 | 4.44E+04 | 2.35E+05 | 4.44E+04 |
| Comp Molar Flow (CO2) (kgmole/h) | 14.994 | 64.1046 | 10.8654 | 64.1046 | 10.8654 |
| Comp Molar Flow (Nitrogen) (kgmole/h) | 10.497 | 51.1377 | 1.3473 | 51.1377 | 1.3473 |
| Comp Molar Flow (Methane) (kgmole/h) | 2686.926 | 12540.2795 | 894.3505 | 12540.2795 | 894.3505 |
| Comp Molar Flow (Ethane) (kgmole/h) | 157.737 | 594.0489 | 194.6361 | 594.0489 | 194.6361 |
| Comp Molar Flow (Propane) (kgmole/h) | 71.37 | 179.9304 | 176.9196 | 179.9304 | 176.9196 |
| Comp Molar Flow (i-Butane) (kgmole/h) | 16.194 | 26.2151 | 54.7549 | 26.2151 | 54.7549 |
| Comp Molar Flow (n-Butane) (kgmole/h) | 19.791 | 25.4446 | 73.5104 | 25.4446 | 73.5104 |
| Comp Molar Flow (i-Pentane) (kgmole/h) | 7.197 | 5.1288 | 30.8562 | 5.1288 | 30.8562 |
| Comp Molar Flow (n-Pentane) (kgmole/h) | 5.697 | 3.1534 | 25.3316 | 3.1534 | 25.3316 |
| Comp Molar Flow (n-Hexane) (kgmole/h) | 5.697 | 1.2804 | 27.2046 | 1.2804 | 27.2046 |
| Comp Molar Flow (n-Heptane) (kgmole/h) | 3 | 0.2725 | 14.7275 | 0.2725 | 14.7275 |
| Comp Molar Flow (n-Octane) (kgmole/h) | 0.9 | 0.0327 | 4.4673 | 0.0327 | 4.4673 |

TABLE 2-continued

Case 2 - Ethane Plus Process. 99.4% Ethane Recovery

| Name | 10 | 11 | 17 | 18 | 20 |
|---|---|---|---|---|---|
| Vapor Fraction | 1 | 1 | 0 | 0 | 1 |
| Temperature (C) | 84.61 | 40 | −99.62 | −101.5 | −101.1 |
| Pressure (bar_g) | 49.06 | 48.56 | 46.56 | 24.5 | 24 |
| Molar Flow (kgmole/h) | 4627 | 4627 | 4627 | 4627 | 1.82E+04 |
| Mass Flow (kg/h) | 7.48E+04 | 7.48E+04 | 7.48E+04 | 7.48E+04 | 2.93E+05 |
| Comp Molar Flow (CO2) (kgmole/h) | 11.8192 | 11.8192 | 11.8192 | 11.8192 | 46.3489 |
| Comp Molar Flow (Nitrogen) (kgmole/h) | 17.6546 | 17.9646 | 17.9646 | 17.9646 | 70.4495 |
| Comp Molar Flow (Methane) (kgmole/h) | 4595.5854 | 4595.5854 | 4595.5854 | 4595.5854 | 18021.8258 |
| Comp Molar Flow (Ethane) (kgmole/h) | 1.7233 | 1.7233 | 1.7233 | 1.7233 | 6.7572 |
| Comp Molar Flow (Propane) (kgmole/h) | 0 | 0 | 0 | 0 | 0 |
| Comp Molar Flow (i-Butane) (kgmole/h) | 0 | 0 | 0 | 0 | 0 |
| Comp Molar Flow (n-Butane) (kgmole/h) | 0 | 0 | 0 | 0 | 0 |
| Comp Molar Flow (i-Pentane) (kgmole/h) | 0 | 0 | 0 | 0 | 0 |
| Comp Molar Flow (n-Pentane) (kgmole/h) | 0 | 0 | 0 | 0 | 0 |
| Comp Molar Flow (n-Hexane) (kgmole/h) | 0 | 0 | 0 | 0 | 0 |
| Comp Molar Flow (n-Heptane) (kgmole/h) | 0 | 0 | 0 | 0 | 0 |
| Comp Molar Flow (n-Octane) (kgmole/h) | 0 | 0 | 0 | 0 | 0 |

| Name | 22 | 23 | 24 | 25 | 26 |
|---|---|---|---|---|---|
| Vapor Fraction | 1 | 1 | 1 | 1 | 1 |
| Temperature (C) | −72.95 | 16.46 | 16.46 | 16.46 | 106.9 |
| Pressure (bar_g) | 23.5 | 23 | 23 | 23 | 62.75 |
| Molar Flow (kgmole/h) | 1.82E+04 | 1.82E+04 | 1.35E+04 | 4627 | 1.35E+04 |
| Mass Flow (kg/h) | 2.93E+05 | 2.93E+05 | 2.19E+05 | 7.48E+04 | 2.19E+05 |
| Comp Molar Flow (CO2) (kgmole/h) | 46.3489 | 46.3489 | 34.5299 | 11.819 | 34.5299 |
| Comp Molar Flow (Nitrogen) (kgmole/h) | 70.4495 | 70.4495 | 52.4849 | 17.9646 | 52.4849 |
| Comp Molar Flow (Methane) (kgmole/h) | 18021.8258 | 18021.8258 | 13426.26 | 4595.5656 | 13426.2602 |
| Comp Molar Flow (Ethane) (kgmole/h) | 6.7572 | 6.7572 | 5.0341 | 1.7231 | 5.0341 |
| Comp Molar Flow (Propane) (kgmole/h) | 0 | 0 | 0 | 0 | 0 |
| Comp Molar Flow (i-Butane) (kgmole/h) | 0 | 0 | 0 | 0 | 0 |
| Comp Molar Flow (n-Butane) (kgmole/h) | 0 | 0 | 0 | 0 | 0 |
| Comp Molar Flow (i-Pentane) (kgmole/h) | 0 | 0 | 0 | 0 | 0 |
| Comp Molar Flow (n-Pentane) (kgmole/h) | 0 | 0 | 0 | 0 | 0 |
| Comp Molar Flow (n-Hexane) (kgmole/h) | 0 | 0 | 0 | 0 | 0 |
| Comp Molar Flow (n-Heptane) (kgmole/h) | 0 | 0 | 0 | 0 | 0 |
| Comp Molar Flow (n-Octane) (kgmole/h) | 0 | 0 | 0 | 0 | 0 |

| Name | 40 | 41 | 50 | 51 | 61 |
|---|---|---|---|---|---|
| Vapor Fraction | 0 | 0.2848 | 0 | 0.2663 | 0.3284 |
| Temperature (C) | −66.79 | −47.35 | −38.43 | −12.19 | 25.17 |
| Pressure (bar_g) | 24.13 | 24.13 | 24.18 | 23.68 | 24.3 |
| Molar Flow (kgmole/h) | 2212 | 2212 | 2554 | 2554 | 2206 |
| Mass Flow (kg/h) | 6.11E+04 | 6.11E+04 | 8.78E+04 | 8.78E+04 | 8.51E+04 |
| Comp Molar Flow (CO2) (kgmole/h) | 135.9214 | 135.9214 | 114.4527 | 114.4527 | 95.416 |
| Comp Molar Flow (Nitrogen) (kgmole/h) | 0.1467 | 0.1467 | 0.0367 | 0.0367 | 0 |
| Comp Molar Flow (Methane) (kgmole/h) | 856.9684 | 856.9684 | 521.5347 | 521.5347 | 29.1718 |
| Comp Molar Flow (Ethane) (kgmole/h) | 958.7866 | 958.7866 | 1213.5745 | 1213.5745 | 1315.8993 |

TABLE 2-continued

Case 2 - Ethane Plus Process. 99.4% Ethane Recovery

| | | | | | |
|---|---|---|---|---|---|
| Comp Molar Flow (Propane) (kgmole/h) | 197.0634 | 197.0634 | 404.0662 | 404.0662 | 449.4052 |
| Comp Molar Flow (i-Butane) (kgmole/h) | 26.9554 | 26.9554 | 85.1134 | 85.1134 | 91.5086 |
| Comp Molar Flow (n-Butane) (kgmole/h) | 25.877 | 25.877 | 102.4393 | 102.4393 | 108.8985 |
| Comp Molar Flow (i-Pentane) (kgmole/h) | 5.1499 | 5.1499 | 36.4616 | 36.4616 | 37.8035 |
| Comp Molar Flow (n-Pentane) (kgmole/h) | 3.1596 | 3.1596 | 28.7491 | 28.7491 | 29.6488 |
| Comp Molar Flow (n-Hexane) (kgmole/h) | 1.2789 | 1.2789 | 28.5318 | 28.5318 | 28.9752 |
| Comp Molar Flow (n-Heptane) (kgmole/h) | 0.2719 | 0.2719 | 14.9888 | 14.9888 | 15.1124 |
| Comp Molar Flow (n-Octane) (kgmole/h) | 0.0326 | 0.0326 | 4.4931 | 4.4931 | 4.5148 |

| Name | 70 | 71 | 72 | Btm-Reb-Feed |
|---|---|---|---|---|
| Vapor Fraction | 1 | 1 | 1 | 0 |
| Temperature (C) | 17 | −36.93 | −65.29 | 14.73 |
| Pressure (bar_g) | 48.06 | 47.56 | 47.06 | 24.3 |
| Molar Flow (kgmole/h) | 4627 | 4627 | 4627 | 2206 |
| Mass Flow (kg/h) | 7.48E+04 | 7.48E+04 | 7.48E+04 | 8.51E+04 |
| Comp Molar Flow (CO2) (kgmole/h) | 11.8192 | 11.8192 | 11.8192 | 95.416 |
| Comp Molar Flow (Nitrogen) (kgmole/h) | 17.9646 | 17.9646 | 17.9646 | 0 |
| Comp Molar Flow (Methane) (kgmole/h) | 4595.5854 | 4595.5854 | 4595.5854 | 29.1718 |
| Comp Molar Flow (Ethane) (kgmole/h) | 1.7233 | 1.7233 | 1.7233 | 1315.8993 |
| Comp Molar Flow (Propane) (kgmole/h) | 0 | 0 | 0 | 449.4052 |
| Comp Molar Flow (i-Butane) (kgmole/h) | 0 | 0 | 0 | 91.5086 |
| Comp Molar Flow (n-Butane) (kgmole/h) | 0 | 0 | 0 | 108.8985 |
| Comp Molar Flow (i-Pentane) (kgmole/h) | 0 | 0 | 0 | 37.8035 |
| Comp Molar Flow (n-Pentane) (kgmole/h) | 0 | 0 | 0 | 29.6488 |
| Comp Molar Flow (n-Hexane) (kgmole/h) | 0 | 0 | 0 | 28.9752 |
| Comp Molar Flow (n-Heptane) (kgmole/h) | 0 | 0 | 0 | 15.1124 |
| Comp Molar Flow (n-Octane) (kgmole/h) | 0 | 0 | 0 | 4.5148 |

LNGs

| Name | LNG-100 | LNG-101 | LNG-102 | LNG-103 | LNG-104 |
|---|---|---|---|---|---|
| Number of Sides | 3 | 2 | 2 | 2 | 3 |
| LMTD (C) | 6.731 | 3.862 | 4.044 | 8.19 | 2.516 |
| UA (Calculated) (kJ/C-h) | 9.51E+06 | 6.58E+06 | 1.74E+06 | 1.33E+06 | 3.57E+06 |
| Hot Pinch Temperature (C) | 16.29 | −99.62 | −65.29 | −36.93 | 16.29 |
| Cold Pinch Temperature (C) | 14.78 | −101.1 | −66.79 | −38.43 | 14.73 |
| LMTD (C) | 6.731 | 3.862 | 4.044 | 8.19 | 2.516 |
| Exchanger Cold Duty (kW) | 1.78E+04 | 7056 | 1954 | 3019 | 2495 |
| Minimum Approach (C) | 1.515 | 1.5 | 1.5 | 1.5 | 1.565 |

Air coolers

| Name | AC-100 | AC-101 |
|---|---|---|
| Duty (kW) | −2373 | −1.07E+04 |

TABLE 2-continued

| Case 2 - Ethane Plus Process. 99.4% Ethane Recovery | | |
|---|---|---|
| Compressors | | |
| Name | K-101 | K-102 |
| Volume Flow (m3/h) | 247.7 | 723.5 |
| Adiabatic Efficiency | 78 | 80 |
| Polytropic Efficiency | 80 | 82 |
| Capacity (act feed vol flow) (ACT_m3/h) | 4379 | 1.28E+04 |
| Polytropic Head (m) | 1.18E+04 | 1.62E+04 |
| Adiabatic Head (m) | 1.15E+04 | 1.58E+04 |
| Energy (kW) | 2999 | 1.17E+04 |

| Expanders | |
|---|---|
| Name | K-100 |
| Energy (kW) | 2999 |
| Feed Pressure (bar_g) | 60.49 |
| Product Pressure (bar_g) | 24.5 |
| Feed Temperature (C) | −46 |
| Product Temperature (C) | −83.75 |
| Adiabatic Efficiency | 85 |

| Reboiled Absorbers 2 | |
|---|---|
| Name | T-101 |
| Number of Trays | 25 |

| Separators | |
|---|---|
| Name | V-100 |
| Vessel Temperature (C) | −46 |
| Vessel Pressure (bar_g) | 60.49 |
| Vessel Diameter (m) | 1.981 |
| Vessel Length or Height (m) | 6.934 |

| Case 3 - Ethane Plus Process, 99.6% Ethane Recovery | | | |
|---|---|---|---|
| Name | Feed | Sales Gas | NGL |
| Vapor Fraction | 1 | 1 | 0 |
| Temperature (C) | 24 | 40 | 22.33 |
| Pressure (bar_g) | 60.99 | 62.25 | 23.3 |
| Molar Flow (kgmole/h) | 1.50E+04 | 1.35E+04 | 1490 |
| Mass Flow (kg/h) | 2.79E+05 | 2.18E+05 | 6.11E+04 |
| Comp Molar Flow (CO2) (kgmole/h) | 74.97 | 28.2414 | 46.7281 |
| Comp Molar Flow (Nitrogen) (kgmole/h) | 52.485 | 52.485 | 0 |
| Comp Molar Flow (Methane) (kgmole/h) | 13434.63 | 13426.2129 | 8.3599 |
| Comp Molar Flow (Ethane) (kgmole/h) | 788.685 | 2.8332 | 785.8545 |
| Comp Molar Flow (Propane) (kgmole/h) | 356.85 | 0 | 356.8524 |
| Comp Molar Flow (i-Butane) (kgmole/h) | 80.97 | 0 | 80.9703 |
| Comp Molar Flow (n-Butane) (kgmole/h) | 98.955 | 0 | 98.9552 |
| Comp Molar Flow (i-Pentane) (kgmole/h) | 35.985 | 0 | 35.985 |
| Comp Molar Flow (n-Pentane) (kgmole/h) | 28.485 | 0 | 28.485 |
| Comp Molar Flow (n-Hexane) (kgmole/h) | 28.485 | 0 | 28.485 |
| Comp Molar Flow (n-Heptane) (kgmole/h) | 15 | 0 | 15 |
| Comp Molar Flow (n-Octane) (kgmole/h) | 4.5 | 0 | 4.5 |

-continued

Case 3 - Ethane Plus Process, 99.6% Ethane Recovery

| Streams Name | 1 | 2 | 2a | 2b | 2c |
|---|---|---|---|---|---|
| Vapor Fraction | 1 | 1 | 0.9988 | 0.9988 | 0.8869 |
| Temperature (C) | 24 | 24 | 13.39 | 13.4 | −48 |
| Pressure (bar_g) | 60.99 | 60.99 | 60.74 | 60.74 | 60.49 |
| Molar Flow (kgmole/h) | 6000 | 9000 | 9000 | 9000 | 9000 |
| Mass Flow (kg/h) | 1.12E+05 | 1.68E+05 | 1.68E+05 | 1.68E+05 | 1.68E+05 |
| Comp Molar Flow (CO2) (kgmole/h) | 29.988 | 44.982 | 44.982 | 44.982 | 44.982 |
| Comp Molar Flow (Nitrogen) (kgmole/h) | 20.994 | 31.491 | 31.491 | 31.491 | 31.491 |
| Comp Molar Flow (Methane) (kgmole/h) | 5373.852 | 8060.778 | 8060.778 | 8060.778 | 8060.78 |
| Comp Molar Flow (Ethane) (kgmole/h) | 315.474 | 473.211 | 473.211 | 473.211 | 473.211 |
| Comp Molar Flow (Propane) (kgmole/h) | 142.74 | 214.11 | 214.11 | 214.11 | 214.11 |
| Comp Molar Flow (i-Butane) (kgmole/h) | 32.388 | 48.582 | 48.582 | 48.582 | 48.582 |
| Comp Molar Flow (n-Butane) (kgmole/h) | 39.582 | 59.373 | 59.373 | 59.373 | 59.373 |
| Comp Molar Flow (i-Pentane) (kgmole/h) | 14.394 | 21.591 | 21.591 | 21.591 | 21.591 |
| Comp Molar Flow (n-Pentane) (kgmole/h) | 11.394 | 17.091 | 17.091 | 17.091 | 17.091 |
| Comp Molar Flow (n-Hexane) (kgmole/h) | 11.394 | 17.091 | 17.091 | 17.091 | 17.091 |
| Comp Molar Flow (n-Heptane) (kgmole/h) | 6 | 9 | 9 | 9 | 9 |
| Comp Molar Flow (n-Octane) (kgmole/h) | 1.8 | 2.7 | 2.7 | 2.7 | 2.7 |

| Name | 3 | 4 | 5 | 8 | 9 |
|---|---|---|---|---|---|
| Vapor Fraction | 0.8869 | 1 | 0 | 0.8952 | 0.3773 |
| Temperature (C) | −48 | −48 | −48 | −86.73 | −72.65 |
| Pressure (bar_g) | 60.49 | 60.49 | 60.49 | 23.5 | 23.5 |
| Molar Flow (kgmole/h) | 6000 | 1.33E+04 | 1696 | 1.33E+04 | 1696 |
| Mass Flow (kg/h) | 1.12E+05 | 2.31E+05 | 4.83E+04 | 2.31E+05 | 4.83E+04 |
| Comp Molar Flow (CO2) (kgmole/h) | 29.988 | 62.5824 | 12.3876 | 62.5824 | 12.3876 |
| Comp Molar Flow (Nitrogen) (kgmole/h) | 20.994 | 50.8746 | 1.6104 | 50.8746 | 1.6104 |
| Comp Molar Flow (Methane) (kgmole/h) | 5373.852 | 12392.7863 | 1041.8437 | 12392.7863 | 1041.84 |
| Comp Molar Flow (Ethane) (kgmole/h) | 315.474 | 572.3489 | 216.3361 | 572.3489 | 216.336 |
| Comp Molar Flow (Propane) (kgmole/h) | 142.74 | 168.565 | 188.285 | 168.565 | 188.285 |
| Comp Molar Flow (i-Butane) (kgmole/h) | 32.388 | 24.188 | 56.782 | 24.188 | 56.782 |
| Comp Molar Flow (n-Butane) (kgmole/h) | 39.582 | 23.3842 | 75.5708 | 23.3842 | 75.5708 |
| Comp Molar Flow (i-Pentane) (kgmole/h) | 14.394 | 4.6984 | 31.2866 | 4.6984 | 31.2866 |
| Comp Molar Flow (n-Pentane) (kgmole/h) | 11.394 | 2.8893 | 25.5957 | 2.8893 | 25.5957 |
| Comp Molar Flow (n-Hexane) (kgmole/h) | 11.394 | 1.1815 | 27.3035 | 1.1815 | 27.3035 |
| Comp Molar Flow (n-Heptane) (kgmole/h) | 6 | 0.2541 | 14.7459 | 0.2541 | 14.7459 |
| Comp Molar Flow (n-Octane) (kgmole/h) | 1.8 | 0.0309 | 4.4691 | 0.0309 | 4.4691 |

| Name | 10 | 11 | 17 | 18 | 26 |
|---|---|---|---|---|---|
| Vapor Fraction | 1 | 1 | 0 | 0 | 1 |
| Temperature (C) | 89.95 | 40 | −100.9 | −102.7 | 111.1 |
| Pressure (bar_g) | 49.62 | 49.12 | 47.12 | 23.5 | 62.75 |
| Molar Flow (kgmole/h) | 4266 | 4266 | 4266 | 4266 | 1.35E+04 |
| Mass Flow (kg/h) | 6.89E+04 | 6.89E+04 | 6.89E+04 | 6.89E+04 | 2.18E+05 |
| Comp Molar Flow (CO2) (kgmole/h) | 8.9185 | 8.9185 | 8.9185 | 8.9185 | 28.2414 |
| Comp Molar Flow (Nitrogen) (kgmole/h) | 16.5742 | 16.5742 | 16.5742 | 16.5742 | 52.485 |
| Comp Molar Flow (Methane) (kgmole/h) | 4239.8566 | 4239.8566 | 4239.8566 | 4239.8566 | 13426.2 |
| Comp Molar Flow (Ethane) (kgmole/h) | 0.8948 | 0.8948 | 0.8948 | 0.8948 | 2.8332 |

-continued

Case 3 - Ethane Plus Process, 99.6% Ethane Recovery

| | | | | | |
|---|---|---|---|---|---|
| Comp Molar Flow (Propane) (kgmole/h) | 0 | 0 | 0 | 0 | 0 |
| Comp Molar Flow (i-Butane) (kgmole/h) | 0 | 0 | 0 | 0 | 0 |
| Comp Molar Flow (n-Butane) (kgmole/h) | 0 | 0 | 0 | 0 | 0 |
| Comp Molar Flow (1-Pentane) (kgmole/h) | 0 | 0 | 0 | 0 | 0 |
| Comp Molar Flow (n-Pentane) (kgmole/h) | 0 | 0 | 0 | 0 | 0 |
| Comp Molar Flow (n-Hexane) (kgmole/h) | 0 | 0 | 0 | 0 | 0 |
| Comp Molar Flow (n-Heptane) (kgmole/h) | 0 | 0 | 0 | 0 | 0 |
| Comp Molar Flow (n-Octane) (kgmole/h) | 0 | 0 | 0 | 0 | 0 |

| Name | 20 | 22 | 23 | 24 | 25 |
|---|---|---|---|---|---|
| Vapor Fraction | 1 | 1 | 1 | 1 | 1 |
| Temperature (C) | −102.4 | −78.8 | 16.5 | 16.5 | 16.5 |
| Pressure (bar_g) | 23 | 22.5 | 22 | 22 | 22 |
| Molar Flow (kgmole/h) | 1.78E+04 | 1.78E+04 | 1.78E+04 | 1.35E+04 | 4266 |
| Mass Flow (kg/h) | 2.87E+05 | 2.87E+05 | 2.87E+05 | 2.18E+05 | 6.89E+04 |
| Comp Molar Flow (CO2) (kgmole/h) | 37.1597 | 37.1597 | 37.1597 | 28.2414 | 8.9183 |
| Comp Molar Flow (Nitrogen) (kgmole/h) | 69.0592 | 69.0592 | 69.0592 | 52.485 | 16.5742 |
| Comp Molar Flow (Methane) (kgmole/h) | 17666.0696 | 17666.0696 | 17666.07 | 13426.2129 | 4239.86 |
| Comp Molar Flow (Ethane) (kgmole/h) | 3.7279 | 3.7279 | 3.7279 | 2.8332 | 0.8947 |
| Comp Molar Flow (Propane) (kgmole/h) | 0 | 0 | 0 | 0 | 0 |
| Comp Molar Flow (i-Butane) (kgmole/h) | 0 | 0 | 0 | 0 | 0 |
| Comp Molar Flow (n-Butane) (kgmole/h) | 0 | 0 | 0 | 0 | 0 |
| Comp Molar Flow (i-Pentane) (kgmole/h) | 0 | 0 | 0 | 0 | 0 |
| Comp Molar Flow (n-Pentane) (kgmole/h) | 0 | 0 | 0 | 0 | 0 |
| Comp Molar Flow (n-Hexane) (kgmole/h) | 0 | 0 | 0 | 0 | 0 |
| Comp Molar Flow (n-Heptane) (kgmole/h) | 0 | 0 | 0 | 0 | 0 |
| Comp Molar Flow (n-Octane) (kgmole/h) | 0 | 0 | 0 | 0 | 0 |

| Name | 40 | 41 | 50 | 51 | 61 |
|---|---|---|---|---|---|
| Vapor Fraction | 0 | 0.328 | 0 | 0.2707 | 0.3352 |
| Temperature (C) | −75 | −55.77 | −45.98 | −18.53 | 22.33 |
| Pressure (bar_g) | 23.13 | 23.13 | 23.18 | 22.68 | 23.3 |
| Molar Flow (kgmole/h) | 2328 | 2328 | 2588 | 2588 | 2241 |
| Mass Flow (kg/h) | 6.15E+04 | 6.15E+04 | 8.78E+04 | 8.78E+04 | 8.63E+04 |
| Comp Molar Flow (CO2) (kgmole/h) | 140.4386 | 140.4386 | 124.2694 | 124.2694 | 112.994 |
| Comp Molar Flow (Nitrogen) (kgmole/h) | 0.1684 | 0.1684 | 0.0375 | 0.0375 | 0 |
| Comp Molar Flow (Methane) (kgmole/h) | 1056.9381 | 1056.9381 | 592.654 | 592.654 | 30.6022 |
| Comp Molar Flow (Ethane) (kgmole/h) | 891.3219 | 891.3219 | 1174.824 | 1174.824 | 1333.21 |
| Comp Molar Flow (Propane) (kgmole/h) | 181.9147 | 181.9147 | 396.9861 | 396.9861 | 448.953 |
| Comp Molar Flow (i-Butane) (kgmole/h) | 24.7162 | 24.7162 | 84.3247 | 84.3247 | 91.238 |
| Comp Molar Flow (n-Butane) (kgmole/h) | 23.6782 | 23.6782 | 101.7059 | 101.7059 | 108.56 |
| Comp Molar Flow (i-Pentane) (kgmole/h) | 4.7098 | 4.7098 | 36.3345 | 36.3345 | 37.7058 |
| Comp Molar Flow (n-Pentane) (kgmole/h) | 2.8917 | 2.8917 | 28.6701 | 28.6701 | 29.5777 |

-continued

| Case 3 - Ethane Plus Process, 99.6% Ethane Recovery | | | | | |
|---|---|---|---|---|---|
| Comp Molar Flow (n-Hexane) (kgmole/h) | 1.1797 | 1.1797 | 28.5025 | 28.5025 | 28.9329 |
| Comp Molar Flow (n-Heptane) (kgmole/h) | 0.2536 | 0.2536 | 14.9831 | 14.9831 | 15.1001 |
| Comp Molar Flow (n-Octane) (kgmole/h) | 0.0308 | 0.0308 | 4.4925 | 4.4925 | 4.5129 |

| Name | 70 | 71 | 72 | Btm-Reb-Feed |
|---|---|---|---|---|
| Vapor Fraction | 1 | 1 | 1 | 0 |
| Temperature (C) | 14 | −44.48 | −73.5 | 11.45 |
| Pressure (bar_g) | 48.62 | 48.12 | 47.62 | 23.3 |
| Molar Flow (kgmole/h) | 4266 | 4266 | 4266 | 2241 |
| Mass Flow (kg/h) | 6.89E+04 | 6.89E+04 | 6.89E+04 | 8.63E+04 |
| Comp Molar Flow (CO2) (kgmole/h) | 8.9185 | 8.9185 | 8.9185 | 112.994 |
| Comp Molar Flow (Nitrogen) (kgmole/h) | 16.5742 | 16.5742 | 16.5742 | 0 |
| Comp Molar Flow (Methane) (kgmole/h) | 4239.8566 | 4239.8566 | 4239.8566 | 30.6022 |
| Comp Molar Flow (Ethane) (kgmole/h) | 0.8948 | 0.8948 | 0.8948 | 1333.2093 |
| Comp Molar Flow (Propane) (kgmole/h) | 0 | 0 | 0 | 448.953 |
| Comp Molar Flow (i-Butane) (kgmole/h) | 0 | 0 | 0 | 91.238 |
| Comp Molar Flow (n-Butane) (kgmole/h) | 0 | 0 | 0 | 108.5602 |
| Comp Molar Flow (i-Pentane) (kgmole/h) | 0 | 0 | 0 | 37.7058 |
| Comp Molar Flow (n-Pentane) (kgmole/h) | 0 | 0 | 0 | 29.5777 |
| Comp Molar Flow (n-Hexane) (kgmole/h) | 0 | 0 | 0 | 28.9329 |
| Comp Molar Flow (n-Heptane) (kgmole/h) | 0 | 0 | 0 | 15.1001 |
| Comp Molar Flow (n-Octane) (kgmole/h) | 0 | 0 | 0 | 4.5129 |

| LNGs<br>Name | LNG-100 | LNG-101 | LNG-102 | LNG-103 | LNG-104 |
|---|---|---|---|---|---|
| Number of Sides | 3 | 2 | 2 | 2 | 3 |
| LMTD (C) | 7.66 | 5.639 | 3.877 | 8.786 | 3.943 |
| UA (Calculated) (kJ/C-h) | 8.71E+06 | 3.72E+06 | 2.00E+06 | 1.26E+06 | 2.40E+06 |
| Hot Pinch Temperature (C) | 13.4 | −100.9 | −73.5 | −44.48 | 13.39 |
| Cold Pinch Temperature (C) | 11.67 | −102.4 | −75 | −45.98 | 11.45 |
| Exchanger Cold Duty (kW) | 1.85E+04 | 5819 | 2151 | 3082 | 2625 |
| Minimum Approach (C) | 1.721 | 1.5 | 1.5 | 1.5 | 1.947 |

| Air coolers<br>Name | AC-100 | AC-101 |
|---|---|---|
| Duty (kW) | −2456 | −1.14E+04 |

| Compressors<br>Name | K-101 | K-102 |
|---|---|---|
| Adiabatic Efficiency | 78 | 80 |
| Volume Flow (m3/h) | 228.3 | 723 |
| Polytropic Efficiency | 80 | 82 |
| Capacity (act feed vol flow) (ACT_m3/h) | 4224 | 1.34E+04 |
| Polytropic Head (m) | 1.28E+04 | 1.70E+04 |
| Adiabatic Head (m) | 1.25E+04 | 1.66E+04 |
| Feed Pressure (bar_g) | 22 | 22 |
| Product Pressure (bar_g) | 49.62 | 62.75 |
| Feed Temperature (C) | 16.5 | 16.5 |
| Product Temperature (C) | 89.95 | 111.1 |
| Capacity (act feed vol flow) (ACT_m3/h) | 4224 | 1.34E+04 |
| Energy (kW) | 2998 | 1.23E+04 |

-continued

| Case 3 - Ethane Plus Process, 99.6% Ethane Recovery | |
|---|---|
| Expanders | |
| Name | K-100 |
| Feed Pressure (bar_g) | 60.49 |
| Product Pressure (bar_g) | 23.5 |
| Feed Temperature (C) | −48 |
| Product Temperature (C) | −86.73 |
| Energy (kW) | 2998 |
| Adiabatic Efficiency | 85 |
| Reboiled Absorbers | |
| Name | T-101 |
| Number of Trays | 25 |
| Separators | |
| Name | V-100 |
| Vessel Temperature (C) | −48 |
| Vessel Pressure (bar_g) | 60.49 |
| Vessel Diameter (m) | 1.981 |
| Vessel Length or Height (m) | 6.934 |

TABLE 4

| Case 4 - "HHH" Process for Propane Recovery | | | | | |
|---|---|---|---|---|---|
| Streams | | | | | |
| Name | 1 | 2 | 3 | 4 | 5 |
| Temperature (C) | 30 | −42 | −42 | −42 | −66.4 |
| Pressure (bar_g) | 66.69 | 64.72 | 64.72 | 64.72 | 37.3 |
| Molar Flow (MMSCFD) | 1100 | 1100 | 1033 | 67.07 | 1033 |
| Mass Flow (kg/h) | 1.01E+06 | 1.01E+06 | 9.13E+05 | 9.27E+04 | 9.13E+05 |
| Actual Volume Flow (m3/h) | 1.71E+04 | 8852 | 8627 | 225.4 | 1.45E+04 |
| Heat Flow (kcal/h) | −1.06E+09 | −1.11E+09 | −1.03E+09 | −8.37E+07 | −1.04E+09 |
| Molecular Weight | 18.36 | 18.36 | 17.75 | 27.76 | 17.75 |
| Comp Mass Flow (Nitrogen) (kg/h) | 1227.6782 | 1227.6782 | 1205.9044 | 21.7737 | 1205.9044 |
| Comp Mass Flow (CO2) (kg/h) | 18323.012 | 18323.012 | 16771.4786 | 1551.5334 | 16771.4786 |
| Comp Mass Flow (Methane) (kg/h) | 789124.7999 | 789124.7999 | 756327.1616 | 32797.6383 | 756327.162 |
| Comp Mass Flow (Ethane) (kg/h) | 93400.6622 | 93400.6622 | 80000.5179 | 13400.1443 | 80000.5179 |
| Comp Mass Flow (Propane) (kg/h) | 58460.0677 | 58460.0677 | 40476.5553 | 17983.5124 | 40476.5553 |
| Comp Mass Flow (i-Butane) (kg/h) | 14646.9866 | 14646.9866 | 7839.433 | 6807.5535 | 7839.433 |
| Comp Mass Flow (n-Butane) (kg/h) | 14965.3957 | 14965.3957 | 6941.1765 | 8024.2191 | 6941.1765 |
| Comp Mass Flow (i-Pentane) (kg/h) | 6324.0785 | 6324.0785 | 1962.2073 | 4361.8712 | 1962.2073 |
| Comp Mass Flow (n-Pentane) (kg/h) | 3557.2969 | 3557.2969 | 920.6113 | 2636.6855 | 920.6113 |
| Comp Mass Flow (n-Hexane) (kg/h) | 2832.5815 | 2832.5815 | 363.7525 | 2468.829 | 363.7525 |
| Comp Mass Flow (n-Heptane) (kg/h) | 2195.7521 | 2195.7521 | 132.7129 | 2063.0392 | 132.7129 |
| Comp Mass Flow (n-Octane) (kg/h) | 625.7858 | 625.7858 | 17.1973 | 608.5885 | 17.1973 |
| Comp Mass Flow (H2S) (kg/h) | 9.8548 | 9.8548 | 8.3504 | 1.5044 | 8.3504 |
| Comp Mass Flow (M-Mercaptan) (kg/h) | 19.4303 | 19.4303 | 11.194 | 8.2363 | 11.194 |
| Name | 6 | 7 | 9 | 11 | 12 |
| Temperature (C) | −72.73 | −67.72 | 30 | −51.53 | −29.08 |
| Pressure (bar_g) | 37 | 37.3 | 66.69 | 20.66 | 20.31 |
| Molar Flow (MMSCFD) | 1049 | 154.8 | 1100 | 154.8 | 154.8 |
| Mass Flow (kg/h) | 8.92E+05 | 1.89E+05 | 1.01E+06 | 1.89E+05 | 1.89E+05 |
| Actual Volume Flow (m3/h) | 1.43E+04 | 448.1 | 1.71E+04 | 3569 | 5007 |
| Heat Flow (kcal/h) | −1.04E+09 | −1.87E+08 | −1.06E+09 | −1.78E+08 | −1.73E+08 |
| Molecular Weight | 17.07 | 24.53 | 18.36 | 24.53 | 24.53 |
| Comp Mass Flow (Nitrogen) (kg/h) | 1224.397 | 36.36 | 1227.6782 | 36.36 | 36.36 |
| Comp Mass Flow (CO2) (kg/h) | 17957.5704 | 4923.5438 | 18323.012 | 4923.5438 | 4923.5438 |
| Comp Mass Flow (Methane) (kg/h) | 782994.1137 | 75829.0309 | 789124.7999 | 75829.0309 | 75829.0309 |
| Comp Mass Flow (Ethane) (kg/h) | 89454.28 | 49638.7719 | 93400.6622 | 49638.7719 | 49638.7719 |
| Comp Mass Flow (Propane) (kg/h) | 209.5012 | 40487.6072 | 58460.0677 | 40487.6072 | 40487.6072 |
| Comp Mass Flow (i-Butane) (kg/h) | 0.0967 | 7839.3923 | 14646.9866 | 7839.3923 | 7839.3923 |
| Comp Mass Flow (n-Butane) (kg/h) | 0.0086 | 6941.1716 | 14965.3957 | 6941.1716 | 6941.1716 |
| Comp Mass Flow (i-Pentane) (kg/h) | 0 | 1962.2073 | 6324.0785 | 1962.2073 | 1962.2073 |
| Comp Mass Flow (n-Pentane) (kg/h) | 0 | 920.6113 | 3557.2969 | 920.6113 | 920.6113 |
| Comp Mass Flow (n-Hexane) (kg/h) | 0 | 363.7525 | 2832.5815 | 363.7525 | 363.7525 |

TABLE 4-continued

Case 4 - "HHH" Process for Propane Recovery

| | | | | | |
|---|---|---|---|---|---|
| Comp Mass Flow (n-Heptane) (kg/h) | 0 | 132.7129 | 2195.7521 | 132.7129 | 132.7129 |
| Comp Mass Flow (n-Octane) (kg/h) | 0 | 17.1973 | 625.7858 | 17.1973 | 17.1973 |
| Comp Mass Flow (H2S) (kg/h) | 9.437 | 4.8277 | 9.8548 | 4.8277 | 4.8277 |
| Comp Mass Flow (M-Mercaptan) (kg/h) | 0.0018 | 11.1933 | 19.4303 | 11.1933 | 11.1933 |

| Name | 13 | 14 | 15 | 16 | 17 |
|---|---|---|---|---|---|
| Temperature (C) | 29.5 | −43.45 | −57.35 | −57.35 | 73.52 |
| Pressure (bar_g) | 20.31 | 18.34 | 18.34 | 18 | 19 |
| Molar Flow (MMSCFD) | 67.07 | 245.7 | 245.7 | 180.9 | 40.99 |
| Mass Flow (kg/h) | 9.27E+04 | 2.66E+05 | 2.66E+05 | 1.78E+05 | 1.04E+05 |
| Actual Volume Flow (m3/h) | 3268 | 9837 | 6972 | 6997 | 228 |
| Heat Flow (kcal/h) | −7.46E+07 | −2.56E+08 | −2.66E+08 | −1.86E+08 | −6.21E+07 |
| Molecular Weight | 27.76 | 21.75 | 21.75 | 19.76 | 50.85 |
| Comp Mass Flow (Nitrogen) (kg/h) | 21.7737 | 59.6622 | 59.6622 | 58.1337 | 0 |
| Comp Mass Flow (CO2) (kg/h) | 1551.5334 | 8980.0955 | 8980.0955 | 6475.0479 | 0.0293 |
| Comp Mass Flow (Methane) (kg/h) | 32797.6383 | 120381.7547 | 120381.7547 | 108626.666 | 0.0028 |
| Comp Mass Flow (Ethane) (kg/h) | 13400.1443 | 134914.0579 | 134914.0579 | 62626.1396 | 412.7767 |
| Comp Mass Flow (Prapane) (kg/h) | 17983.5124 | 1749.1969 | 1749.1969 | 234.0551 | 58237.0645 |
| Comp Mass Flow (i-Butane) (kg/h) | 6807.5535 | 1.3432 | 1.3432 | 0.0593 | 14646.8865 |
| Comp Mass Flow (n-Butane) (kg/h) | 8024.2191 | 0.1383 | 0.1383 | 0.0038 | 14965.3869 |
| Comp Mass Flow (i-Pentane) (kg/h) | 4361.8712 | 0.0002 | 0.0002 | 0 | 6324.0785 |
| Comp Mass Flow (n-Pentane) (kg/h) | 2636.6855 | 0 | 0 | 0 | 3557.2969 |
| Comp Mass Flow (n-Hexane) (kg/h) | 2468.829 | 0 | 0 | 0 | 2832.5815 |
| Comp Mass Flow (n-Heptane) (kg/h) | 2063.0392 | 0 | 0 | 0 | 2195.7521 |
| Comp Mass Flow (n-Octane) (kg/h) | 608.5885 | 0 | 0 | 0 | 625.7858 |
| Comp Mass Flow (H2S) (kg/h) | 1.5044 | 12.828 | 12.828 | 6.268 | 0.064 |
| Comp Mass Flow (M-Mercaptan) (kg/h) | 8.2363 | 0.016 | 0.016 | 0.0011 | 19.4285 |

| Name | 18 | 19 | 20 | 21 | 22 |
|---|---|---|---|---|---|
| Temperature (C) | −57.35 | −57.16 | 67.38 | 73.52 | 38 |
| Pressure (bar_g) | 18 | 20 | 19 | 19 | 17.79 |
| Molar Flow (MMSCFD) | 64.82 | 64.82 | 97.83 | 56.84 | 180.9 |
| Mass Flow (kg/h) | 8.81E+04 | 8.81E+04 | 2.37E+05 | 1.33E+05 | 1.78E+05 |
| Actual Volume Flow (m3/h) | 188.8 | 188.9 | 526 | 2877 | 1.17E+04 |
| Heat Flow (kcal/h) | −8.00E+07 | −8.00E+07 | −1.44E+08 | −7.28E+07 | −1.77E+08 |
| Molecular Weight | 27.28 | 27.28 | 48.56 | 46.9 | 19.76 |
| Comp Mass Flow (Nitrogen) (kg/h) | 1.5285 | 1.5285 | 0 | 0 | 58.1333 |
| Comp Mass Flow (CO2) (kg/h) | 2505.0476 | 2505.0476 | 0.2175 | 0.1882 | 6475.063 |
| Comp Mass Flow (Methane) (kg/h) | 11755.0883 | 11755.0883 | 0.0304 | 0.0276 | 108626.438 |
| Comp Mass Flow (Ethane) (kg/h) | 72287.9184 | 72287.9184 | 1895.5012 | 1482.7245 | 62626.9568 |
| Comp Mass Flow (Prapane) (kg/h) | 1515.1417 | 1515.1417 | 157458.7296 | 99221.6651 | 233.7447 |
| Comp Mass Flow (i-Butane) (kg/h) | 1.2839 | 1.2839 | 29148.445 | 14501.5585 | 0.0593 |
| Comp Mass Flow (n-Butane) (kg/h) | 0.1345 | 0.1345 | 27197.8289 | 12232.442 | 0.0038 |
| Comp Mass Flow (i-Pentane) (kg/h) | 0.0002 | 0.0002 | 9314.2237 | 2990.1452 | 0 |
| Comp Mass Flow (n-Pentane) (kg/h) | 0 | 0 | 5007.102 | 1449.8051 | 0 |
| Comp Mass Flow (n-Hexane) (kg/h) | 0 | 0 | 3421.9242 | 589.3427 | 0 |
| Comp Mass Flow (n-Heptane) (kg/h) | 0 | 0 | 2435.4061 | 239.654 | 0 |
| Comp Mass Flow (n-Octane) (kg/h) | 0 | 0 | 661.9771 | 36.1913 | 0 |
| Comp Mass Flow (H2S) (kg/h) | 6.56 | 6.56 | 0.2839 | 0.2199 | 6.268 |
| Comp Mass Flow (M-Mercaptan) (kg/h) | 0.0149 | 0.0149 | 43.5333 | 24.1048 | 0.0011 |

| Name | 23 | 24 | 25 | 26 | 27 |
|---|---|---|---|---|---|
| Temperature (C) | 107.6 | 48.89 | −71.5 | −73.15 | −55.12 |
| Pressure (bar_g) | 39.59 | 39.25 | 39.04 | 37.1 | 36.79 |
| Molar Flow (MMSCFD) | 180.9 | 180.9 | 170.7 | 170.7 | 1049 |
| Mass Flow (kg/h) | 1.78E+05 | 1.78E+05 | 1.68E+05 | 1.68E+05 | 8.92E+05 |
| Actual Volume Flow (m3/h) | 6648 | 5396 | 695.1 | 764.1 | 1.85E+04 |
| Heat Flow (kcal/h) | −1.71E+08 | −1.77E+08 | −1.89E+08 | −1.89E+08 | −1.03E+09 |
| Molecular Weight | 19.76 | 19.76 | 19.76 | 19.76 | 17.07 |
| Comp Mass Flow (Nitrogen) (kg/h) | 58.1333 | 58.1333 | 54.8525 | 54.8525 | 1224.397 |
| Comp Mass Flow (CO2) (kg/h) | 6475.063 | 6475.063 | 6109.6356 | 6109.6356 | 17957.5704 |
| Comp Mass Flow (Methane) (kg/h) | 108626.4383 | 108626.4383 | 102495.9829 | 102495.983 | 782994.114 |
| Comp Mass Flow (Ethane) (kg/h) | 62626.9568 | 62626.9568 | 59092.534 | 59092.534 | 89454.28 |
| Comp Mass Flow (Propane) (kg/h) | 233.7447 | 233.7447 | 220.5531 | 220.5531 | 209.5012 |
| Comp Mass Flow (i-Butane) (kg/h) | 0.0593 | 0.0593 | 0.056 | 0.056 | 0.0967 |
| Comp Mass Flow (n-Butane) (kg/h) | 0.0038 | 0.0038 | 0.0036 | 0.0036 | 0.0086 |
| Comp Mass Flow (i-Pentane) (kg/h) | 0 | 0 | 0 | 0 | 0 |
| Comp Mass Flow (n-Pentane) (kg/h) | 0 | 0 | 0 | 0 | 0 |
| Comp Mass Flow (n-Hexane) (kg/h) | 0 | 0 | 0 | 0 | 0 |
| Comp Mass Flow (n-Heptane) (kg/h) | 0 | 0 | 0 | 0 | 0 |
| Comp Mass Flow (n-Octane) (kg/h) | 0 | 0 | 0 | 0 | 0 |

TABLE 4-continued

| Case 4 - "HHH" Process for Propane Recovery | | | | | |
|---|---|---|---|---|---|
| Comp Mass Flow (H2S) (kg/h) | 6.268 | 6.268 | 5.9143 | 5.9143 | 9.437 |
| Comp Mass Flow (M-Mercaptan) (kg/h) | 0.0011 | 0.0011 | 0.001 | 0.001 | 0.0018 |

| Name | 28 | 29 | 30 |
|---|---|---|---|
| Temperature (C) | 26.8 | 88.56 | 48.99 |
| Pressure (bar_g) | 36.59 | 70.88 | 70.1 |
| Molar Flow (MMSCFD) | 1049 | 1049 | 1049 |
| Mass Flow (kg/h) | 8.92E+05 | 8.92E+05 | 8.92E+05 |
| Actual Volume Flow (m3/h) | 3.17E+04 | 2.03E+04 | 1.74E+04 |
| Heat Flow (kcal/h) | −9.81E+08 | −9.54E+08 | −9.77E+08 |
| Molecular Weight | 17.07 | 17.07 | 17.07 |
| Comp Mass Flow (Nitrogen) (kg/h) | 1224.397 | 1224.397 | 1224.397 |
| Comp Mass Flow (CO2) (kg/h) | 17957.5704 | 17957.5704 | 17957.5704 |
| Comp Mass Flow (Methane) (kg/h) | 782994.1137 | 782994.1137 | 782994.1137 |
| Comp Mass Flow (Ethane) (kg/h) | 89454.28 | 89454.28 | 89454.28 |
| Comp Mass Flow (Propane) (kg/h) | 209.5012 | 209.5012 | 209.5012 |
| Comp Mass Flow (i-Butane) (kg/h) | 0.0967 | 0.0967 | 0.0967 |
| Comp Mass Flow (n-Butane) (kg/h) | 0.0086 | 0.0086 | 0.0086 |
| Comp Mass Flow (i-Pentane) (kg/h) | 0 | 0 | 0 |
| Comp Mass Flow (n-Pentane) (kg/h) | 0 | 0 | 0 |
| Comp Mass Flow (n-Hexane) (kg/h) | 0 | 0 | 0 |
| Comp Mass Flow (n-Heptane) (kg/h) | 0 | 0 | 0 |
| Comp Mass Flow (n-Octane) (kg/h) | 0 | 0 | 0 |
| Comp Mass Flow (H2S) (kg/h) | 9.437 | 9.437 | 9.437 |
| Comp Mass Flow (M-Mercaptan) (kg/h) | 0.0018 | 0.0018 | 0.0018 |

I claim:

1. A method for separation of methane and more volatile components from ethane and less volatile components making up a high pressure feed gas stream, the improvement comprising:

(a) cooling the feed gas stream, which consists of a cooling stream and a first heat exchanger feed stream, in a first heat exchanger to form a partly condensed first stream, where heat is exchanged only against a low pressure, heated overhead gas stream to form a compressor feed stream;

(b) separating the first stream into a vapor second stream and a liquid third stream;

(c) passing the second stream through an expander to a low pressure to form a partly condensed fourth stream and thereafter feeding the fourth stream to a mid-level stage in a demethanizer column;

(d) flashing to a low pressure the third stream to form a partly vaporized fifth stream and thereafter feeding the fifth stream to a stage in the demethanizer column just below the feed stage of the fourth stream;

(e) operating the demethanizer column with upper and lower side reboilers and a bottom reboiler, whereby the upper reboiler withdraws from and returns to the demethanizer column an upper reboiler stream at stages above the feed stage of the fourth stream and the lower reboiler withdraws from and returns to the demethanizer column a lower reboiler stream at stages below the feed stage of the fifth stream;

(f) operating the demethanizer column so that a cooled overhead gas stream is removed from a top stage and indirectly heated in an overhead condenser heat exchanger to form the heated overhead gas stream;

(g) splitting the compressor feed stream into a first recycle stream and a product stream, thereafter operating a first compressor only with expansion power supplied from operation of the expander and compressing the first recycle stream to form a second recycle stream;

(h) compressing to high pressure in a second compressor the product stream to form a sales gas stream consisting substantially of methane and more volatile components; and (i) cooling the first recycle stream sequentially in a first cooler, the bottom reboiler, the lower reboiler, the upper reboiler and the overhead condenser to form a subcooled reflux stream;

(j) flashing the reflux stream to low pressure and feeding the flashed stream to the top stage of the demethanizer; and (k) operating the demethanizer column to produce a liquid bottom stream from a bottom stage consisting substantially of ethane and less volatile components.

2. The method of claim 1 wherein the pressure of the feed gas stream is above about 50 bar.

3. The method of claim 2 wherein the operating pressure in the demethanizer column is about 20 bar.

4. The method of claim 3 wherein the pressure of the recycle stream after compression in the first compressor is above about 30 bar.

5. The method of claim 4 wherein the bottom stream contains over 99 percent of the ethane in the feed gas stream.

6. The method of claim 4 wherein the bottom stream contains over 99.2 percent of the ethane in the feed gas stream.

7. The method of claim 1 wherein:

the feed gas stream is separated to form the cooling stream and the first heat exchanger feed stream;

the first heat exchanger feed stream is cooled in the first heat exchanger and forms the partly condensed first stream;

the cooling stream is cooled in the bottom reboiler to form a return stream;

the return stream is cooled in the first heat exchanger to form a partly condensed first return stream;

a vapor portion of the first return stream is mixed with the vapor portion of the first stream to form the second stream; and a liquid portion of the first return stream is mixed with the liquid portion of the first stream to form the third stream.

8. The method of claim 7 wherein the pressure of the feed gas stream is above about 50 bar.

9. The method of claim 8 wherein the operating pressure in the demethanizer column is about 20 bar.

10. The method of claim 9 wherein the pressure of the recycle stream after compression in the first compressor is above about 30 bar.

11. The method of claim 10 wherein the bottom stream contains over 99 percent of the ethane in the feed gas stream.

12. The method of claim 4 wherein the bottom stream contains over 99.5 percent of the ethane in the feed gas stream.

13. A process for separation of ethane or propane from more volatile components mixed in a high pressure feed gas stream of substantially only natural gas components, the improvement comprising:

(a) cooling the feed gas stream to form a partly condensed first stream thereafter separated to form an expander feed stream and a first liquid stream;

(b) passing the expander stream through an expander to a low pressure to form a partly condensed column stream and thereafter feeding the column stream and the first liquid stream to a mid section of fractionation stages adapted to perform said separation of ethane or propane;

(c) obtaining from the fractionation stages an overhead vapor stream, which is separated into a reflux stream and a product stream, where the reflux stream is compressed in a compressor operated only by power from expansion of the expander; and (d) subcooling the reflux stream and feeding it to a top stage of the fractionation stages; and (e) performing all cooling required for said separation of ethane or propane by heat exchange between streams of the process.

* * * * *